US012686960B2

(12) United States Patent
Na et al.

(10) Patent No.: US 12,686,960 B2
(45) Date of Patent: Jul. 21, 2026

(54) CLOTHES CARE APPARATUS AND CONTROL METHOD THEREFOR

(71) Applicant: Samsung Electronics Co., Ltd., Suwon-si (KR)

(72) Inventors: Joongwon Na, Suwon-si (KR); Minsoo Kim, Suwon-si (KR); Kookjeong Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 560 days.

(21) Appl. No.: 18/226,980

(22) Filed: Jul. 27, 2023

(65) Prior Publication Data

US 2024/0068147 A1 Feb. 29, 2024

Related U.S. Application Data

(63) Continuation of application No. PCT/KR2023/010214, filed on Jul. 17, 2023.

(30) Foreign Application Priority Data

Aug. 31, 2022 (KR) ..... 10-2022-0110321

(51) Int. Cl.
*D06F 34/26* (2020.01)
*D06F 58/10* (2006.01)
(Continued)

(52) U.S. Cl.
CPC ..... *D06F 34/26* (2020.02); *D06F 58/10* (2013.01); *D06F 58/206* (2013.01); *D06F 58/24* (2013.01);
(Continued)

(58) Field of Classification Search
CPC ..... D06F 34/26; D06F 58/10; D06F 58/206; D06F 58/24; D06F 58/26; D06F 2103/32;
(Continued)

(56) References Cited

U.S. PATENT DOCUMENTS 7,418,789 B2 * 9/2008 Choi ..... D06F 58/34 34/602
8,132,339 B2 * 3/2012 Moon ..... D06F 58/10 8/158
(Continued)

FOREIGN PATENT DOCUMENTS

JP 2008-79767 4/2008
JP 2015-107307 6/2015
(Continued)

OTHER PUBLICATIONS

International Search Report, PCT/ISA/2210, dated Oct. 23, 2023, in International Application No. PCT/KR2023/010214.
(Continued)

*Primary Examiner* — David J Laux
(74) *Attorney, Agent, or Firm* — STAAS & HALSEY LLP

(57) ABSTRACT

A clothes care apparatus including an accommodating chamber to accommodate a target; a heat pump apparatus to dehumidify and heat air circulating through the accommodating chamber, the heat pump apparatus including a refrigerant pipe through which a refrigerant circulates and at least one of a compressor, a condenser, an expansion apparatus, or an evaporator; and a condensed water collecting apparatus configured to collect condensed water generated from the heat pump apparatus, and having a storage space in which the collected condensed water is stored, wherein a portion of the refrigerant pipe passes through the storage space so that, in an operating course for taking care of the target, the refrigerant circulating through the refrigerant pipe passes through the portion of the refrigerant pipe while in a high temperature state, to evaporate the condensed water stored in the storage space.

20 Claims, 16 Drawing Sheets

(51) Int. Cl.

| | |
|---|---|
| ***D06F 58/20*** | (2006.01) |
| ***D06F 58/24*** | (2006.01) |
| ***D06F 58/26*** | (2006.01) |
| ***D06F 103/32*** | (2020.01) |
| ***D06F 103/34*** | (2020.01) |
| ***D06F 103/58*** | (2020.01) |
| ***D06F 105/62*** | (2020.01) |

(52) U.S. Cl.
CPC ..... *D06F 58/26* (2013.01); *D06F 2103/32* (2020.02); *D06F 2103/34* (2020.02); *D06F 2103/58* (2020.02); *D06F 2105/62* (2020.02)

(58) Field of Classification Search
CPC ..... D06F 2103/34; D06F 2103/58; D06F 2105/62
See application file for complete search history.

(56) References Cited

U.S. PATENT DOCUMENTS

| | | | | |
|---|---|---|---|---|
| 10,981,430 | B2 | 4/2021 | Jeong | |
| 2009/0151193 | A1* | 6/2009 | Moon | D06F 58/20 34/621 |
| 2010/0083524 | A1* | 4/2010 | Muller | D06F 58/30 34/79 |
| 2010/0154248 | A1 | 6/2010 | Stolze | |
| 2010/0199515 | A1* | 8/2010 | Steffens | D06F 58/24 62/291 |
| 2010/0218566 | A1* | 9/2010 | Moon | D06F 58/203 68/5 C |
| 2012/0292008 | A1* | 11/2012 | Goldberg | D06F 95/00 165/287 |
| 2016/0145793 | A1* | 5/2016 | Ryoo | D06F 58/24 34/595 |
| 2016/0201252 | A1* | 7/2016 | Lee | D06F 58/206 34/130 |
| 2016/0201985 | A1* | 7/2016 | Lee | D06F 58/20 34/73 |
| 2017/0314181 | A1 | 11/2017 | Wakizaka et al. | |
| 2021/0254874 | A1 | 8/2021 | Chinaglia | |
| 2022/0251762 | A1* | 8/2022 | Yoon | D06F 58/08 |
| 2022/0251771 | A1* | 8/2022 | Yoon | D06F 58/26 |
| 2023/0190074 | A1 | 6/2023 | Jeong et al. | |
| 2023/0203742 | A1 | 6/2023 | Park et al. | |

FOREIGN PATENT DOCUMENTS

| | | | |
|---|---|---|---|
| JP | 2017-189297 | | 10/2017 |
| JP | 2021-527193 | A | 10/2021 |
| KR | 10-0587360 | B1 | 6/2006 |
| KR | 10-2010-0130351 | A | 12/2010 |
| KR | 10-1199394 | B1 | 11/2012 |
| KR | 10-1387497 | B1 | 4/2014 |
| KR | 10-1461947 | B1 | 11/2014 |
| KR | 10-2016-0059982 | A | 5/2016 |
| KR | 10-2019-0131368 | A | 11/2019 |
| KR | 10-2020-0098240 | A | 8/2020 |
| KR | 10-2021-0112159 | | 9/2021 |
| KR | 10-2022-0035583 | A | 3/2022 |
| KR | 10-2022-0114693 | A | 8/2022 |
| WO | WO 2022/045558 | A1 | 3/2022 |

OTHER PUBLICATIONS

Written Opinion, PCT/ISA/237, dated Oct. 23, 2023, in International Application No. PCT/KR2023/010214.

* cited by examiner

FIG. 12

| OPERATING MODE | CONDENSED WATER COLLECTED AMOUNT (WATER LEVEL SENSOR INFORMATION) | CLOTHES CARE APPARATUS OPERATING COURSE | CONDENSED WATER HEATING STATE | FORCED AIR CURRENT GENERATING APPARATUS |
|---|---|---|---|---|
| ENERGY-SAVING MODE | COLLECTED AMOUNT < A | NORMAL OPERATION | O | OFF |
| BASIC MODE | A ≤ COLLECTED AMOUNT < B | NORMAL OPERATION | O | ON |
| CONDENSED WATER OVERLOAD OPERATION | B ≤ COLLECTED AMOUNT < C | NORMAL OPERATION | O | ON UNTIL COLLECTED AMOUNT B IS REACHED AFTER TIME OF OPERATING COURSE IS COMPLETED |
| EMERGENCY OPERATION | C ≤ COLLECTED AMOUNT | OPERATION TEMPORARY STOP | X | ON UNTIL COLLECTED AMOUNT C IS REACHED AFTER OPERATING COURSE TEMPORARY STOP |

FIG. 14

| OPERATING MODE | AMBIENT TEMPERATURE | AMBIENT HUMIDITY | CONDENSED WATER HEATING STATE | FORCED AIR CURRENT GENERATING APPARATUS |
|---|---|---|---|---|
| LOW-TEMPERATURE MODE | AMBIENT TEMPERATURE < X | – | O | OFF |
| ROOM-TEMPERATURE MODE | X ≤ AMBIENT TEMPERATURE < Y | AMBIENT HUMIDITY < α | O | OFF |
| | | AMBIENT HUMIDITY ≥ α | | ON |
| HIGH-TEMPERATURE MODE | Y ≤ AMBIENT TEMPERATURE | AMBIENT HUMIDITY < β | O | OFF |
| | | AMBIENT HUMIDITY ≥ β | | ON |

CLOTHES CARE APPARATUS AND CONTROL METHOD THEREFOR

CROSS-REFERENCE TO RELATED APPLICATIONS

This application is a continuation application, under 35 U.S.C. § 111 (a), of International Application No. PCT/KR2023/010214 filed on Jul. 17, 2023, which claims priority under 35 U.S.C. § 119 to Korean Patent Application 10-2022-0110321, filed on Aug. 31, 2022, in the Korean Intellectual Property Office, the disclosures of which are incorporated by reference herein in their entireties.

TECHNICAL FIELD

An embodiment of the disclosure relates to a clothes care apparatus for accelerating evaporation of condensed water, and a control method therefor.

BACKGROUND ART

A clothes care apparatus is a home appliance that takes care of a target, i.e., clothes, in steam or high-temperature dry air. The clothes care apparatus may use a heat pump apparatus to supply high-temperature dry air into an accommodating chamber accommodating the target of the clothes care apparatus. The heat pump apparatus circulates and heats the air inside the hermetic accommodating chamber through heat exchange.

An evaporator of the heat pump apparatus removes moisture by cooling down high-temperature humid air, and while the evaporator dehumidifies the air, condensed water may be generated outside the evaporator. The condensed water may be collected in a separate space, and then discharged directly by a user or discharged to the outside of the clothes care apparatus by using an additional pipe. When the condensed water is discharged directly by the user, the user needs to periodically discharge the collected condensed water, and thus user convenience may be reduced. Also, when the condensed water is discharged by using the additional pipe, the condensed water needs to be discharged to the outside of the clothes care apparatus and thus the clothes care apparatus may be designed in consideration of condensed water discharge.

DESCRIPTION OF EMBODIMENTS

Solution to Problem

A clothes care apparatus according to an embodiment of the disclosure includes an accommodating chamber to accommodate a target; a heat pump apparatus to dehumidify and heat air circulating through the accommodating chamber, the heat pump apparatus including a refrigerant pipe through which a refrigerant circulates and at least one of a compressor, a condenser, an expansion apparatus, or an evaporator; and a condensed water collecting apparatus configured to collect condensed water generated from the heat pump apparatus, and having a storage space in which the collected condensed water is stored, wherein a portion of the refrigerant pipe passes through the storage space so that, in an operating course for taking care of the target, the refrigerant circulating through the refrigerant pipe passes through the portion of the refrigerant pipe while in a high temperature state, to evaporate the condensed water stored in the storage space.

According to an embodiment of the disclosure, the refrigerant in the high temperature state that passes through the portion of the refrigerant pipe may be discharged from the compressor and transmitted to the condenser.

According to an embodiment of the disclosure, the refrigerant in the high temperature state that passes through the portion of the refrigerant pipe may be discharged from the condenser and transmitted to the expansion apparatus.

According to an embodiment of the disclosure, the portion of the refrigerant pipe may have a winding shape.

According to an embodiment of the disclosure, the clothes care apparatus may further include a forced air current generating apparatus configured to generate a forced air current in the condensed water collecting apparatus. The forced air current generating apparatus may be arranged so that, with the collected condensed water being stored in the condensed water collecting apparatus, the forced air current generating apparatus faces a surface of the collected condensed water.

According to an embodiment of the disclosure, the clothes care apparatus may further include at least one water level sensor configured to measure an amount of the collected condensed water in the condensed water collecting apparatus, and a processor configured to, in response to a determination that the amount of the collected condensed water measured by the at least one water level sensor is less than a threshold water level, control the heat pump apparatus to operate, according to a selected operating course, in a condensed water heating state in which the collected condensed water is heated by the refrigerant in the high temperature state that passes through the portion of refrigerant pipe.

According to an embodiment of the disclosure, the processor may be configured to, in response to a determination that the amount of the collected condensed water measured by the at least one water level sensor is greater than the threshold water level, control the heat pump apparatus to stop operation of the selected operating course and operate in a condensed water heating stopped state.

According to an embodiment of the disclosure, the clothes care apparatus may further include at least one water level sensor configured to measure an amount of the collected condensed water in the condensed water collecting apparatus, and a processor configured to control the forced air current generating apparatus based on a result of comparing the amount of the collected condensed water measured by the at least one water level sensor and a first reference water level.

According to an embodiment of the disclosure, the processor may be configured to control power of the forced air current generating apparatus to be turned on in response to a determination that the amount of the collected condensed water measured by the at least one water level sensor is greater than the first reference water level, and control the power of the forced air current generating apparatus to be turned off in response to a determination that the amount of the collected condensed water is less than the first reference water level.

According to an embodiment of the disclosure, the processor may be configured to operate in a condensed water heating state to heat the collected condensed water stored in the storage space through the portion of the refrigerant pipe according to a selected operating course, in response to a determination that the amount of the collected condensed water is greater than a second reference water level that is higher than the first reference water level, operate in a condensed water heating stopped state with the selected operating course being completed, and control power of the forced air current generating apparatus to be turned on until it is determined that the amount of the collected condensed water is less than the second reference water level.

According to an embodiment of the disclosure, the processor may be configured to stop an operation of the heat pump apparatus to stop a selected operating course in response to a determination that the amount of the collected condensed water is greater than a threshold water level that is higher than the first reference water level, operate in a condensed water heating stopped state based on the stopping of the operating course, and control power of the forced air current generating apparatus to be turned on until it is determined that the amount of the collected condensed water is less than the threshold water level.

According to an embodiment of the disclosure, the clothes care apparatus may further include at least one temperature sensor configured to measure an ambient temperature of the condensed water collecting apparatus; at least one humidity sensor configured to measure an ambient humidity of the condensed water collecting apparatus; and a processor configured to control an operation of the forced air current generating apparatus based on the ambient humidity measured by the at least one humidity sensor, in response to a determination that the ambient temperature measured by the at least one temperature sensor is greater than a first reference temperature.

According to an embodiment of the disclosure, the processor may be configured to control power of the forced air current generating apparatus to be turned off in response to a determination that the ambient humidity is less than a reference humidity, and control the power of the forced air current generating apparatus to be turned on in response to a determination that the ambient humidity is greater than the reference humidity.

A control method of controlling a clothes care apparatus, according to an embodiment of the disclosure, includes receiving a selection of an operating course for taking care of a target in an accommodating chamber; and controlling a heat pump apparatus configured to dehumidify and heat air circulating through the accommodating chamber based on the selected operating course, wherein the heat pump apparatus includes a refrigerant pipe through which a refrigerant circulates and at least one of a compressor, a condenser, an expansion apparatus, or an evaporator, wherein the clothes care apparatus includes a condensed water collecting apparatus configured to collect condensed water generated from the heat pump apparatus, and having a storage space in which the collected condensed water is stored, wherein a portion of the refrigerant pipe passes through the storage space, and wherein the control method further comprises, in the selected operating course, controlling the heat pump apparatus so that the refrigerant circulating through the refrigerant pipe passes through the portion of the refrigerant pipe while in a high temperature state, to evaporate the condensed water stored in the storage space.

According to an embodiment of the disclosure, the control method may further include controlling a forced air current generating apparatus arranged to generate a forced air current on a surface of the collected condensed water stored in the condensed water collecting apparatus.

According to an embodiment of the disclosure, the refrigerant in the high temperature state that passes through the portion of the refrigerant pipe may be discharged from the compressor and transmitted to the condenser.

According to an embodiment of the disclosure, the refrigerant in the high temperature state that passes through the portion of the refrigerant pipe may be discharged from the condenser and transmitted to the expansion apparatus.

According to an embodiment of the disclosure, the control method may further include, in response to determining that an amount of the collected condensed water, measured by at least one water level sensor configured to measure the amount of the collected condensed water in the condensed water collecting apparatus, is less than a threshold water level, controlling an operation of the heat pump apparatus according to the selected operating course, and operating in a condensed water heating state in which the collected condensed water is heated by the refrigerant in the high temperature state that passes through the portion of refrigerant pipe; and in response to determining that the amount of the collected condensed water is greater than the threshold water level, stopping operation of the selected operating course and operating in a condensed water heating stopped state.

According to an embodiment of the disclosure, the control method may further include, in response to determining that an amount of the collected condensed water, measured by at least one water level sensor configured to measure the amount of the collected condensed water in the condensed water collecting apparatus, being greater than a first reference water level, controlling power of the forced air current generating apparatus to be turned on; and, in response to determining that the amount of the collected condensed water is less than the first reference water level, controlling the power of the forced air current generating apparatus to be turned off.

According to an embodiment of the disclosure, the control method may further include, in response to determining that an ambient temperature, measured by at least one temperature sensor configured to measure the ambient temperature of the condensed water collecting apparatus, is greater than a first reference temperature, controlling an operation of the forced air current generating apparatus based on an ambient humidity measured by at least one humidity sensor configured to measure the ambient humidity of the condensed water collecting apparatus; in response to determining that the ambient humidity is less than a reference humidity, controlling power of the forced air current generating apparatus to be turned off; and, in response to determining that the ambient humidity is greater than the reference humidity, controlling the power of the forced air current generating apparatus to be turned on.

BRIEF DESCRIPTION OF DRAWINGS

FIG. 12 is a table showing a process by which a clothes care apparatus selects an operating mode according to a collected amount of condensed water of a condensed water collecting apparatus, according to an embodiment of the disclosure.

FIG. 14 is a table showing a process by which a clothes care apparatus selects an operating mode according to an ambient temperature and ambient humidity of a condensed water collecting apparatus, according to an embodiment of the disclosure.

MODE OF DISCLOSURE

Figure 1:
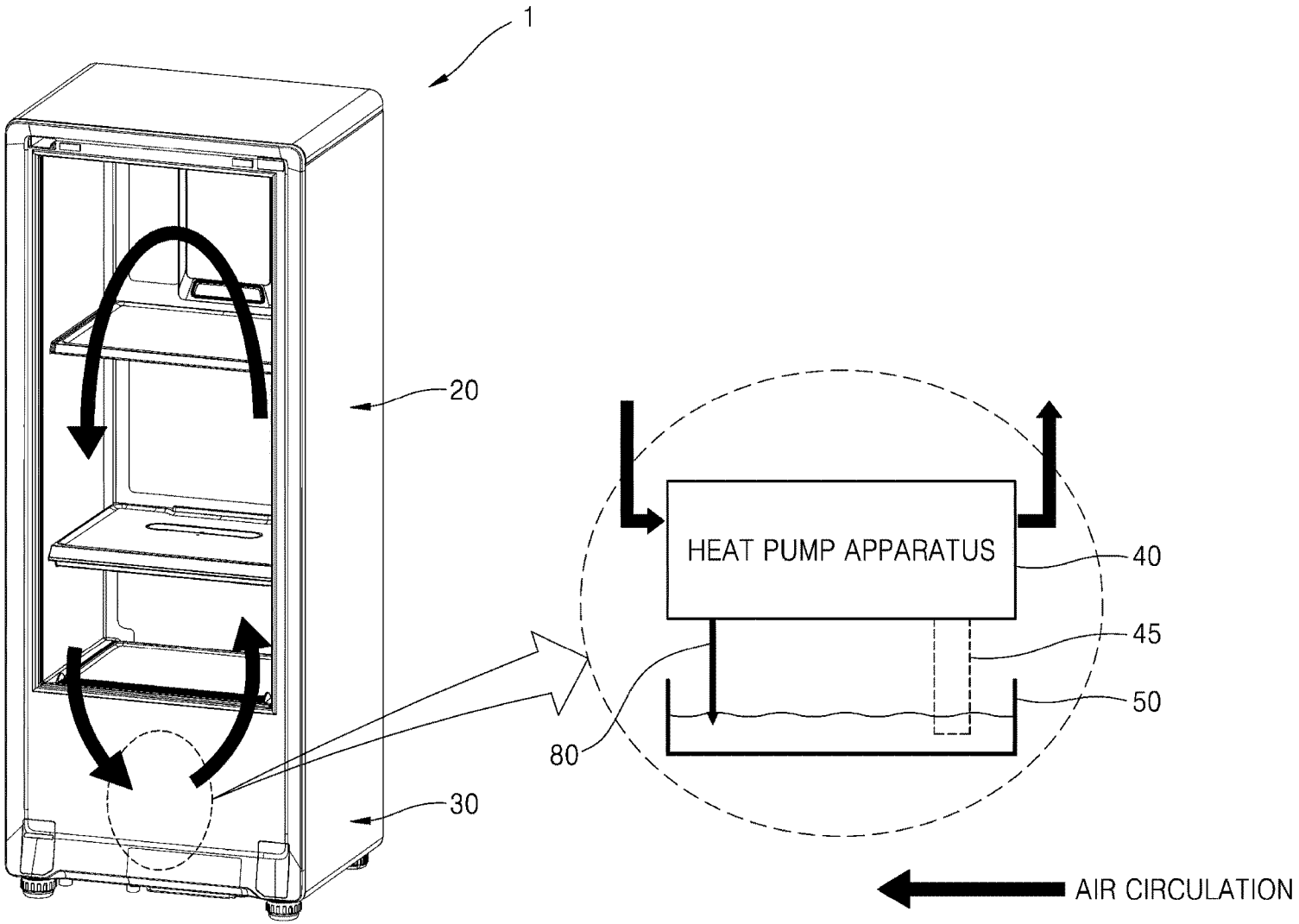
FIG. 1 is a perspective view of a clothes care apparatus according to an embodiment of the disclosure.

The present specification describes and discloses principles of an embodiment of the disclosure such that the scope of right of claims are clarified and one of ordinary skill in the art may implement an embodiment of the disclosure described in the claims. The embodiment of the disclosure may be implemented in various forms.

Throughout the specification, like reference numerals denote like elements. The present specification does not describe all elements of the embodiment of the disclosure, and generic content in the technical field of the disclosure or redundant content of the embodiment of the disclosure is omitted. The term "module" or "unit" used in the specification may be implemented in software, hardware, firmware, or a combination thereof, and according to an embodiment of the disclosure, a plurality of "modules" or "units" may be implemented as one element or one "module" or "unit" may include a plurality of elements.

In the description of an embodiment of the disclosure, certain detailed explanations of related art are omitted when it is deemed that they may unnecessarily obscure the essence of the disclosure. Also, numbers (for example, a first, a second, and the like) used in the description of the specification are merely identifier codes for distinguishing one element from another.

Throughout the disclosure, the expression "at least one of a, b or c" indicates only a, only b, only c, both a and b, both a and c, both b and c, all of a, b, and c, or variations thereof.

Hereinafter, operation principles and various embodiments of the disclosure will be described with reference to accompanying drawings.

FIG. 1 is a perspective view of a clothes care apparatus according to an embodiment of the disclosure.

A clothes care apparatus 1 according to an embodiment of the disclosure may be an apparatus for taking care of a target. For example, the target may include clothes, shoes, or the like.

An accommodating chamber 20 in which the target is accommodated may be provided at an upper part of the clothes care apparatus 1. A machine room 30 where various devices used to generate high-temperature heat for taking care of the target are installed may be provided at a lower part of the accommodating chamber 20. The accommodating chamber 20 and the machine room 30 may be separated from each other.

A heat pump apparatus 40 for supplying high-temperature dry air to the accommodating chamber 20 may be arranged inside the machine room 30. The heat pump apparatus 40 may dehumidify and heat air circulating the accommodating chamber 20. The heat pump apparatus 40 may supply the heated air into the accommodating chamber 20.

Also, a condensed water collecting apparatus 50 configured to collect condensed water generated from the heat pump apparatus 40 may be arranged inside the machine room 30. The condensed water formed on an outer surface of the heat pump apparatus 40 may be collected in the condensed water collecting apparatus 50 through a drain 80.

The heat pump apparatus 40 may include a refrigerant pipe 45 for transmitting a refrigerant circulating the heat pump apparatus 40. The refrigerant circulating through the refrigerant pipe 45 may exchange heat with the air of the accommodating chamber 20, passing through a heat exchanger. For example, the refrigerant circulating the refrigerant pipe 45 may absorb heat while being evaporated in the heat exchanger, thereby dehumidifying the air of the accommodating chamber 20, and may emit heat while being condensed in the heat exchanger, thereby heating the air of the accommodating chamber 20. Accordingly, a refrigerant of a high-temperature state may flow in at least one flow path among the refrigerant pipe 45 of the heat pump apparatus 40, and a refrigerant of a low-temperature state may flow in at least another flow path among the refrigerant pipe 45.

In the clothes care apparatus 1 according to an embodiment of the disclosure, the at least one flow path for transmitting the refrigerant of the high-temperature state among the refrigerant pipe 45 may be provided to pass through the condensed water collecting apparatus 50. The at least one flow path where a high-temperature refrigerant flows may have a high temperature according to heat conduction. The refrigerant pipe 45 of a high temperature passes through a storage space of the condensed water stored in the condensed water collecting apparatus 50, and thus the condensed water may be heated and an evaporation rate of the condensed water may be increased. Accordingly, the refrigerant pipe 45 of the high temperature may operate as a condensed water heating apparatus configured to heat the condensed water stored in the condensed water collecting apparatus 50.

The clothes care apparatus 1 according to an embodiment of the disclosure may heat and evaporate the condensed water by at least one flow path among the refrigerant pipe 45, and thus a process by which a user periodically discharges the condensed water may be omitted. Accordingly, user convenience may be improved. Also, a portion of the refrigerant pipe 45 is used as the condensed water heating apparatus, and thus a pipe for externally discharging the condensed water stored in the condensed water collecting apparatus 50 may not be necessary.

In the disclosure, the clothes care apparatus 1 may correspond to, for example, a dryer, a steam closet, a shoe care apparatus, a clothes wrinkle removing apparatus, or an ironing apparatus.

Figure 2:
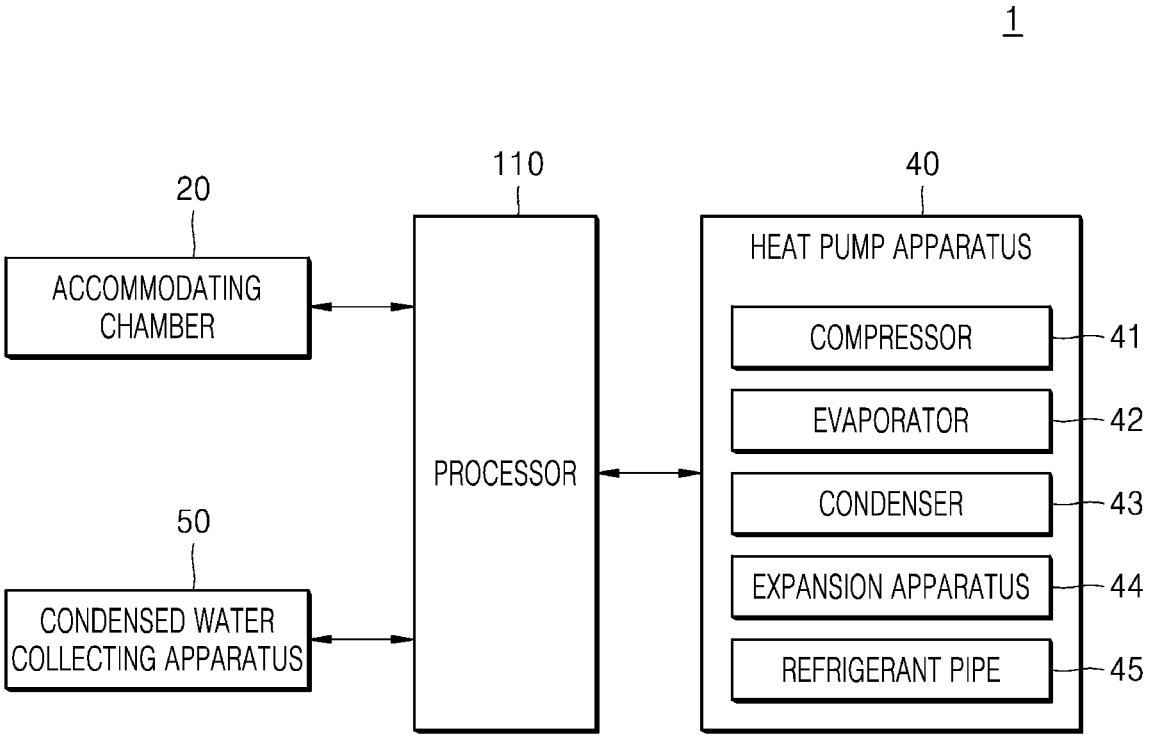
FIG. 2 is a block diagram of a configuration of a clothes care apparatus, according to an embodiment of the disclosure.

FIG. 2 is a block diagram of a configuration of a clothes care apparatus, according to an embodiment of the disclosure.

Referring to FIG. 2, the clothes care apparatus 1 may include the accommodating chamber 20, the heat pump apparatus 40, the condensed water collecting apparatus 50, and a processor 110.

The accommodating chamber 20 may provide a space where the target is accommodated. The air circulating the accommodating chamber 20 may be dehumidified and heated by the heat pump apparatus 40. The target in the accommodating chamber 20 may be taken care of according to a selected operating course.

The heat pump apparatus 40 may include a compressor 41, an evaporator 42, a condenser 43, an expansion apparatus 44, and the refrigerant pipe 45. The compressor 41, evaporator 42, condenser 43, and expansion apparatus 44 are connected to each other through the refrigerant pipe 45 such that a flow path in which the refrigerant circulates is formed. The refrigerant may circulate according to a cycle of the heat pump apparatus 40 while flowing through the refrigerant pipe 45. The heat pump apparatus 40 may dehumidify and heat the air circulating the accommodating chamber 20.

The compressor 41 may adiabatically compress a sucked up gas-phase refrigerant, thereby discharging a high-temperature and high-pressure gas-phase refrigerant. The compressor 41 may include an inverter circuit capable of controlling a driving frequency, and may increase or decrease (change) compression capability, based on an input signal from the processor 110.

The evaporator 42 is a heat exchanger and may exchange heat with the air in the accommodating chamber 20. The air in the accommodating chamber 20 may pass through the evaporator 42 to exchange heat with the refrigerant. The refrigerant may absorb heat of ambient air while being evaporated in the evaporator 42. The air that passes through the evaporator 42 may be cooled down and at the same time, dehumidified, and thus become dry air.

The condenser 43 is a heat exchanger and may exchange heat with the air in the accommodating chamber 20. The air in the accommodating chamber 20 may pass through the condenser 43 to exchange heat with the refrigerant. The refrigerant may emit heat to the ambient air while being condensed in the condenser 43. The air that passes through the condenser 43 may be heated and become high-temperature air.

The expansion apparatus 44 may discharge the decompressed refrigerant by adiabatically expanding the introduced refrigerant.

The refrigerant pipe 45 may circulate the refrigerant by connecting the compressor 41, the evaporator 42, the condenser 43, and the expansion apparatus 44 to each other. At least one flow path among the refrigerant pipe 45 may connect the compressor 41 and the condenser 43, at least another flow path among the refrigerant pipe 45 may connect the condenser 43 and the expansion apparatus 44, at least another flow path among the refrigerant pipe 45 may connect the expansion apparatus 44 and the evaporator 42, and at least another flow path among the refrigerant pipe 45 may connect the evaporator 42 and the compressor 41.

The condensed water collecting apparatus 50 may collect the condensed water generated from the heat pump apparatus 40. The condensed water is water condensed on an outer surface of the evaporator 42, and may be collected in the condensed water collecting apparatus 50 through a drain. According to an embodiment of the disclosure, the condensed water stored in the condensed water collecting apparatus 50 may be heated and evaporated by at least one flow path in a high-temperature state, and thus the condensed water collecting apparatus 50 may not need to be detached from the clothes care apparatus 1.

The processor 110 may generate a control signal for controlling operations of the clothes care apparatus 1. The processor 110 may process data according to a program, instruction, and data stored in a memory, and generate the control signal according to a result of the processing. For example, when a user inputs a command of selecting an operating course, the clothes care apparatus 1 may perform target care corresponding to the selected operating course. The processor 110 may control the heat pump apparatus 40 for the target care.

Figure 3:
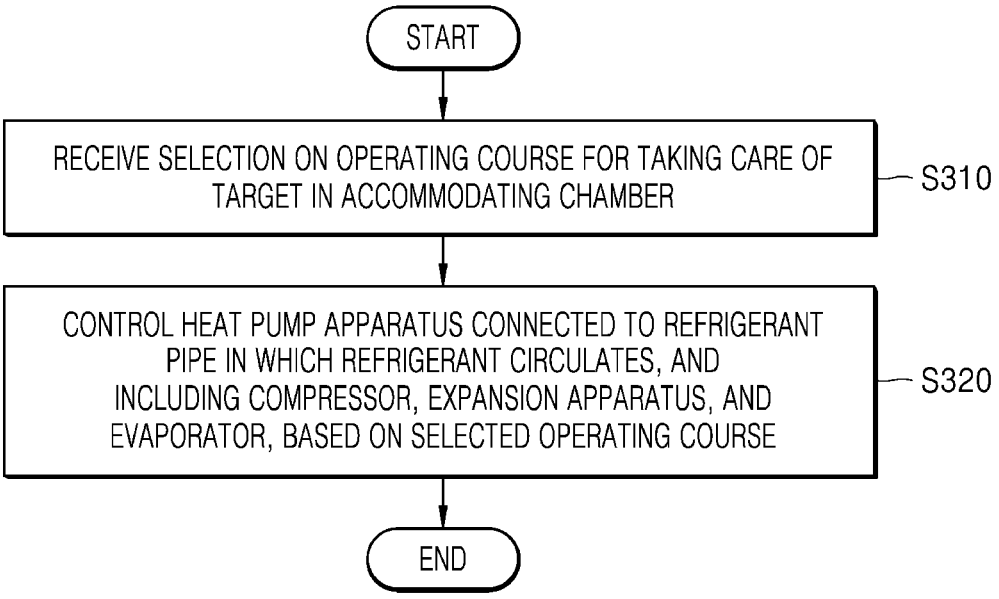
FIG. 3 is a flowchart of a control method for a clothes care apparatus, according to an embodiment of the disclosure.

FIG. 3 is a flowchart of a control method for a clothes care apparatus, according to an embodiment of the disclosure.

Referring to FIG. 3, a clothes care control method corresponding to an operating course selected through the clothes care apparatus 1, according to an embodiment of the disclosure, will be described.

In operation S310, the processor 110 may receive selection on an operating course for taking care of a target in the accommodating chamber 20.

When a user inputs a command of selecting an operating course, the processor 110 may process data according to the selection on the operating course and generate a control signal according to a result of the processing. For example, the operating course may be selected differently according to a clothes type or a shoe type. The operating courses may include a standard course, a quick course, a power course, a clean storage course, and the like.

In operation S320, the processor 110 may control the heat pump apparatus 40 connected to the refrigerant pipe 45 in which a refrigerant circulates, and including the compressor 41, the condenser 43, the expansion apparatus 44, and the evaporator 42, based on the selected operating course.

The processor 110 may control the heat pump apparatus 40 to operate according to the selected operating course. Accordingly, the refrigerant may circulate through the refrigerant pipe 45 of the heat pump apparatus 40. For example, the processor 110 may operate in a condensed water heating state for heating condensed water stored in the condensed water collecting apparatus 50, by at least one flow path passing through the condensed water collecting apparatus 50 among the refrigerant pipe 45.

When a time of the selected operating course is completed, the processor 110 may control the heat pump apparatus 40 not to operate. Accordingly, the refrigerant may not circulate through the refrigerant pipe 45 of the heat pump apparatus 40. For example, the refrigerant of a high-temperature state does not flow in the at least one flow path passing through the condensed water collecting apparatus 50 among the refrigerant pipe 45, and thus the at least one flow path may not be used as a condensed water heating apparatus. At this time, the processor 110 may operate in a condensed water heating stopped state.

Also, when the time of the selected operating course is temporarily stopped, the processor 110 may control the heat pump apparatus 40 not to operate. Accordingly, the processor 110 may operate in the condensed water heating stopped state as described above.

Figure 4:
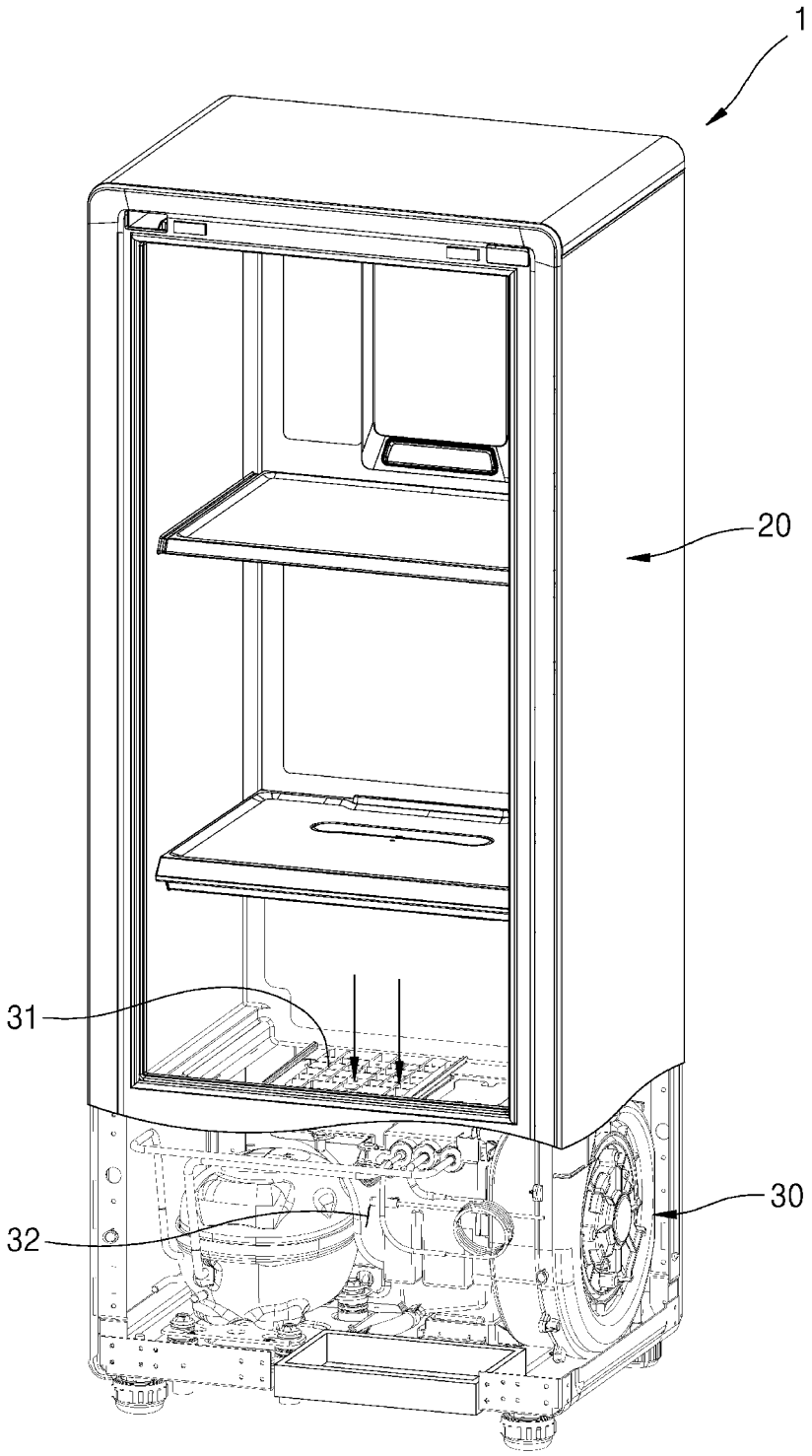
FIG. 4 is a perspective view of a state of a clothes care apparatus, in which a machine room is opened, according to an embodiment of the disclosure.

FIG. 4 is a perspective view of a state of a clothes care apparatus, in which a machine room is opened, according to an embodiment of the disclosure.

Figure 5:
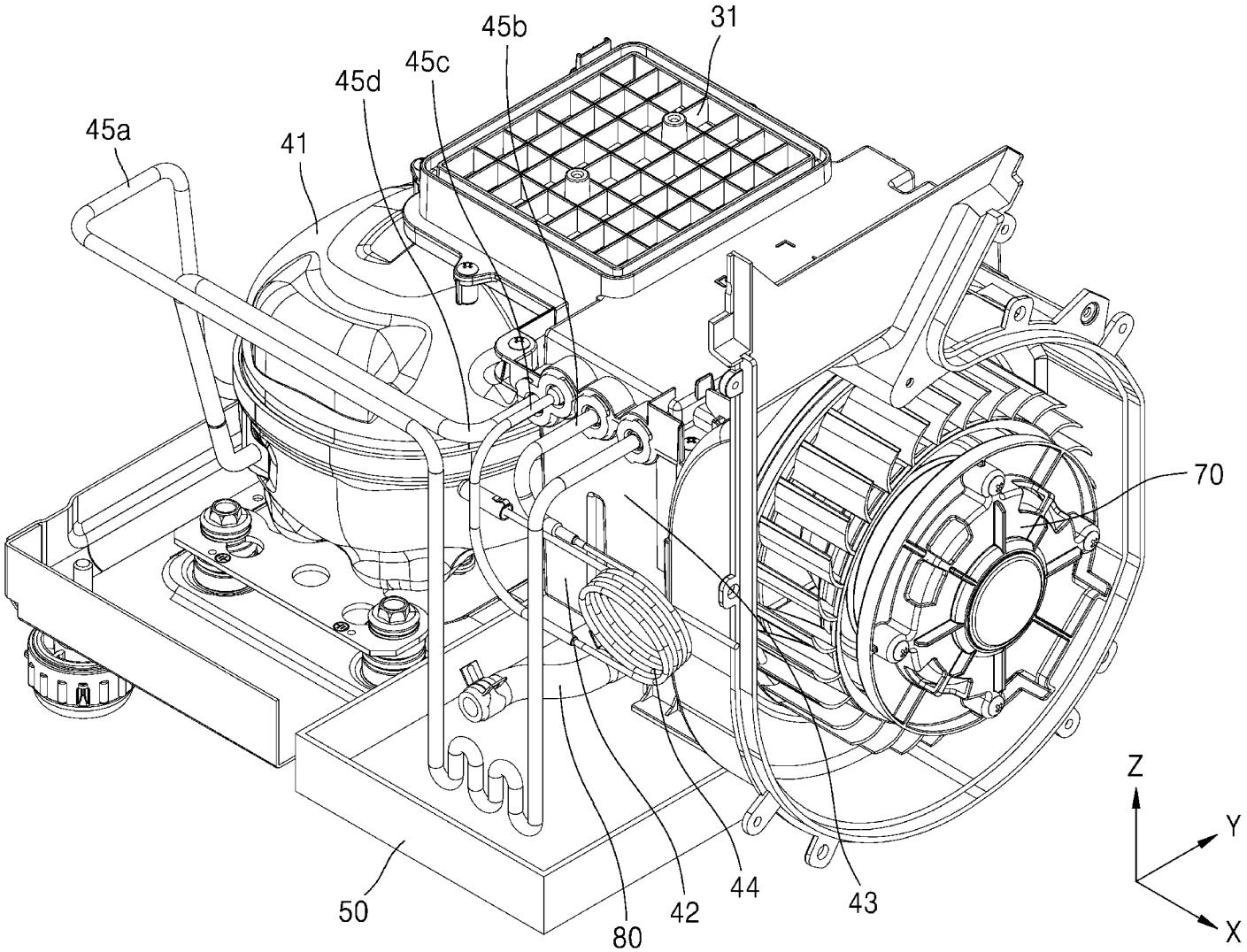
FIG. 5 is a perspective view of a heat pump apparatus applied to a clothes care apparatus, according to an embodiment of the disclosure.

FIG. 5 is a perspective view of a heat pump apparatus applied to a clothes care apparatus, according to an embodiment of the disclosure.

Figure 6:
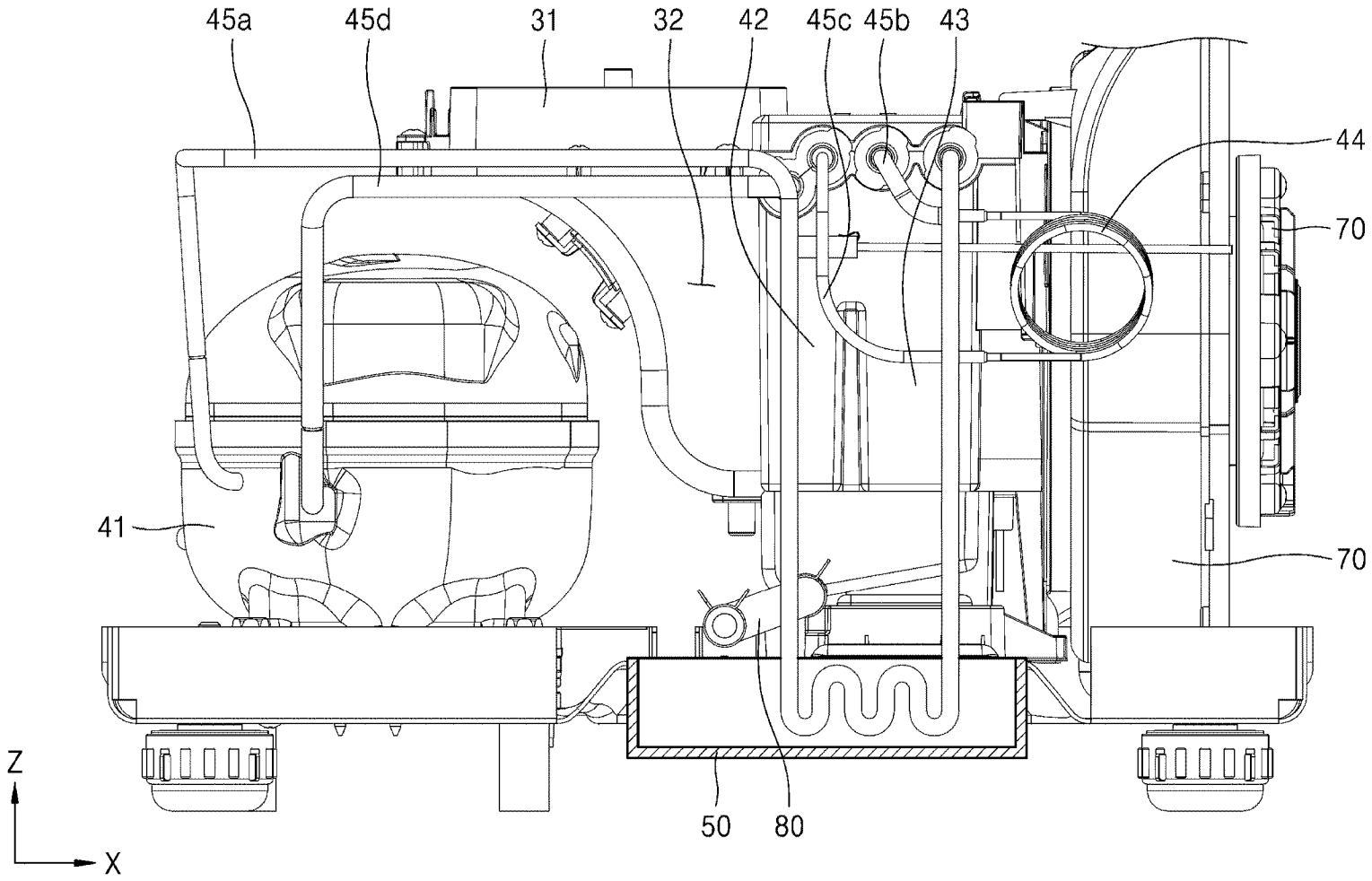
FIG. 6 is a front view of a heat pump apparatus applied to a clothes care apparatus, according to an embodiment of the disclosure.

FIG. 6 is a front view of a heat pump apparatus applied to a clothes care apparatus, according to an embodiment of the disclosure.

Referring to FIG. 4, various devices used to generate high-temperature heat for taking care of a target in the accommodating chamber 20 may be installed inside the machine room 30 of the clothes care apparatus 1. Referring to FIGS. 5 and 6, the heat pump apparatus 40, the condensed water collecting apparatus 50, and an air circulation fan 70, which are some of the various devices installed inside the machine room 30, will be described.

The compressor 41, the condenser 43, the expansion apparatus 44, and the evaporator 42 are sequentially connected by the refrigerant pipe 45 such that a flow path in which a refrigerant circulates is formed. The compressor 41, the condenser 43, the expansion apparatus 44, the evaporator 42, and the refrigerant pipe 45 may configure the heat pump apparatus 40.

The compressor 41 and the expansion apparatus 44 may be spatially separated from the evaporator 42 and the condenser 43. The compressor 41 and the expansion apparatus 44 may be arranged outside an air passage 32, and the evaporator 42 and the condenser 43 may be arranged inside the air passage 32. The air passage 32 may be connected to the accommodating chamber 20 through an air vent 31 (see FIG. 4). Air may be introduced into the air vent 31 through the accommodating chamber 20 and the air vent 31. Air may not be separately introduced to the outside of the air passage 32. Air of the accommodating chamber 20 may be introduced to the air passage 32 through the air vent 31, and may be dehumidified and heated through the evaporator 42 and the condenser 43. Although not limited thereto, the air passage 32 may also be referred to as a duct.

The refrigerant pipe 45 may include a first flow path 45*a*, a second flow path 45*b*, a third flow path 45*c*, and a fourth flow path 45*d*. The first flow path 45*a* may connect the condenser 43 to the compressor 41. The second flow path 45*b* may connect the expansion apparatus 44 to the condenser 43. The third flow path 45*c* may connect the evaporator 42 to the expansion apparatus 44. The fourth flow path 45*d* may connect the compressor 41 to the evaporator 42.

The compressor 41 may be arranged in a hermetic space inside the machine room 30, which is outside the air passage 32. The compressor 41 may transmit the refrigerant to the condenser 43 through the first flow path 45*a*, and receive the refrigerant from the evaporator 42 through the fourth flow path 45*d*.

The evaporator 42 may be arranged inside the air passage 32, and may be arranged in a first direction (for example, X-axis direction) with the condenser 43. The evaporator 42 may transmit the refrigerant to the compressor 41 through the fourth flow path 45*d*, and receive the refrigerant from the expansion apparatus 44 through the third flow path 45*c*.

The condenser 43 may be arranged inside the air passage 32. The condenser 43 may transmit the refrigerant to the expansion apparatus 44 through the second flow path 45*b*, and receive the refrigerant from the compressor 41 through the first flow path 45*a*.

The expansion apparatus 44 may be arranged in the hermetic space in the machine room 30, which is outside the air passage 32. The expansion apparatus 44 may transmit the refrigerant to the evaporator 42 through the third flow path 45*c*, and receive the refrigerant from the condenser 43 through the second flow path 45*b*.

The condensed water collecting apparatus 50 may be arranged below the machine room 30. The condensed water collecting apparatus 50 may store the condensed water collected through the drain 80 connected to the outside of the evaporator 42. The condensed water collecting apparatus 50 may be formed in various types to increase an evaporation amount of the condensed water. For example, the condensed water collecting apparatus 50 may be formed to have a wide surface area within a range that does not reach the compressor 41. The wider the surface area of the condensed water collecting apparatus 50, the greater the evaporation amount of the condensed water, because a surface area of the stored condensed water is increased. As another example, the condensed water may be exposed by not providing an upper cover of the condensed water collecting apparatus 50. Accordingly, the evaporation amount of the condensed water may be increased.

According to an embodiment of the disclosure, a process of discharging the condensed water of the condensed water collecting apparatus 50 is omitted, and thus the condensed water collecting apparatus 50 may not need to be detached, or may not need to be detachable, from the clothes care apparatus 1. However, an embodiment of the disclosure is not limited thereto, and the condensed water collecting apparatus 50 may be detached from the clothes care apparatus 1.

The air circulation fan 70 may be arranged in the air passage 32. The air circulation fan 70 may be arranged in the first direction (the X-axis direction) with the evaporator 42 and the condenser 43. The air circulation fan 70 may suck up air introduced to the air passage 32 through the air vent 31, and discharge the air that has passed through the evaporator 42 and the condenser 43 to the accommodating chamber 20 again. The air introduced from the accommodating chamber 20 through the air vent 31 may be dried while passing through the evaporator 42 of the heat pump apparatus 40, heated while passing through the condenser 43, and discharged to the accommodating chamber 20 again. The air circulation fan 70 may circulate an internal air current of the accommodating chamber 20.

In the clothes care apparatus 1 according to an embodiment of the disclosure, the first flow path 45*a* among the refrigerant pipe 45 may be provided to pass through the inside of the condensed water collecting apparatus 50. The first flow path 45*a* may pass through a condensed water storage space of the condensed water collecting apparatus 50, and correspond to a condensed water heating apparatus configured to heat the stored condensed water.

As will be described in FIG. 8, the first flow path 45*a* may be a refrigerant pipe that transmits a gas-phase refrigerant of a high temperature and high pressure, which is discharged from the compressor 41, to the condenser 43. When the clothes care apparatus 1 operates according to an operating mode, the refrigerant circulates through the refrigerant pipe 45 of the heat pump apparatus 40, and because the first flow path 45*a* transmits the gas-phase refrigerant of the high temperature, the first flow path 45*a* may itself be a pipe in a high-temperature state. A portion of the first flow path 45*a*, which passes through the condensed water storage space of the condensed water collecting apparatus 50, may heat and evaporate the condensed water with high-temperature heat.

For example, the first flow path 45*a* may extend in the first direction (the X-axis direction) and then extend in a second direction (a Z-axis direction) that is perpendicular to the first direction (the X-axis direction) towards the condensed water collecting apparatus 50. The first flow path 45*a* may be provided to pass through the condensed water storage space of the condensed water collecting apparatus 50. The portion of the first flow path 45*a*, which passes through the condensed water storage space of the condensed water collecting apparatus 50, may have a winding shape. Accordingly, a surface area of the first flow path 45*a*, which contacts the condensed water, may be increased, and thus heating and evaporating of the condensed water by the first flow path 45*a* may be accelerated.

Figure 7:
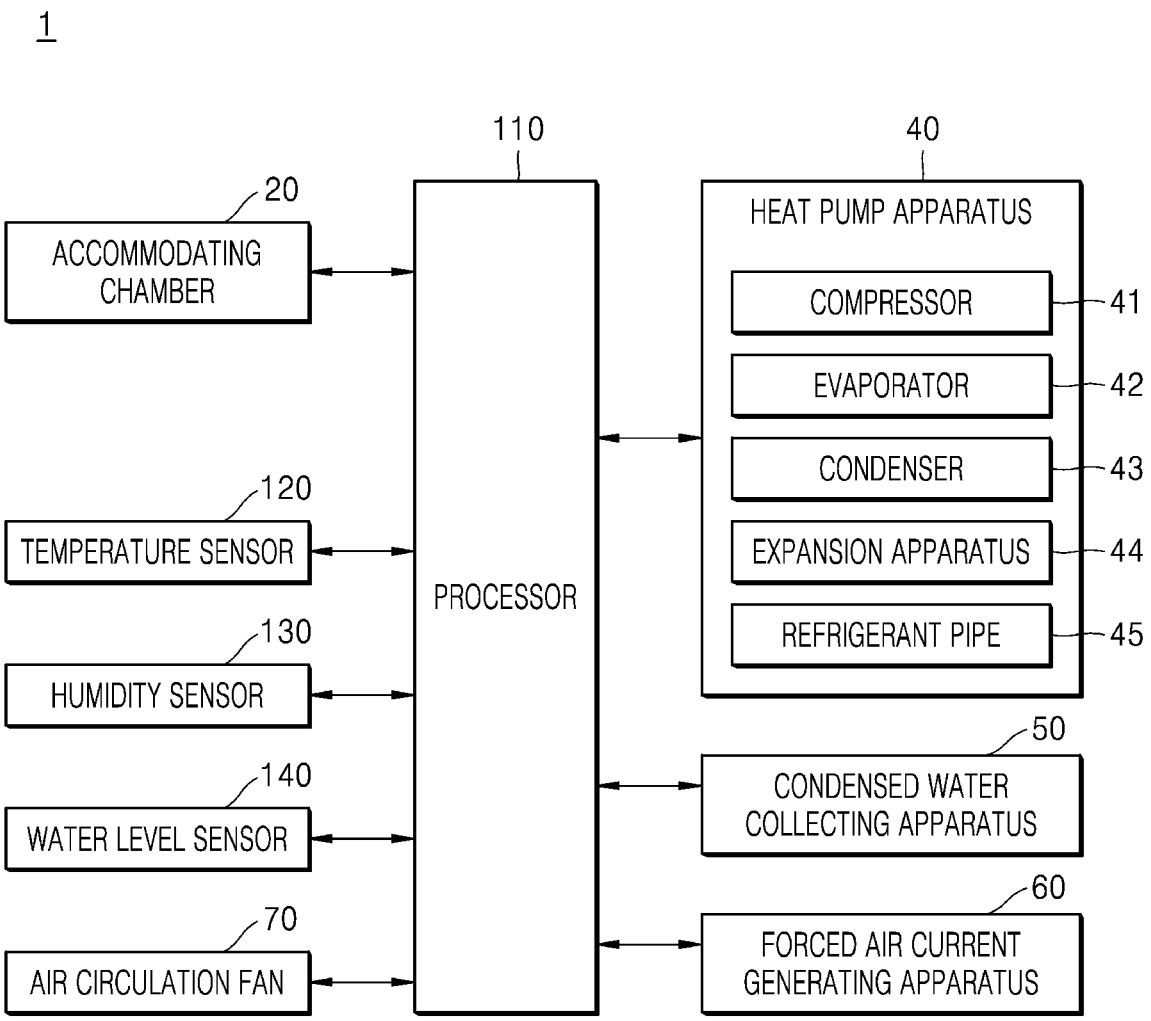
FIG. 7 is a block diagram of a detailed configuration of a clothes care apparatus, according to an embodiment of the disclosure.

FIG. 7 is a block diagram of a detailed configuration of a clothes care apparatus, according to an embodiment of the disclosure.

Referring to FIG. 7, the clothes care apparatus 1 may include the accommodating chamber 20, the heat pump apparatus 40, the condensed water collecting apparatus 50, a forced air current generating apparatus 60, the air circulation fan 70, the processor 110, a temperature sensor 120, a humidity sensor 130, and a water level sensor 140.

The accommodating chamber 20, the heat pump apparatus 40, the condensed water collecting apparatus 50, and the processor 110 of the clothes care apparatus 1 have been described above with reference to FIG. 2, and thus differences between the configurations of FIGS. 2 and 7 will be mainly described in FIG. 7.

The forced air current generating apparatus 60 may be a fan that generates a forced air current in the condensed water collecting apparatus 50. The forced air current generating apparatus 60 may rotate based on a set rotate-per-minute (RPM). The forced air current generating apparatus 60 may increase an air current speed of a surface of the condensed water by generating the forced air current on the surface of the condensed water stored in the condensed water collecting apparatus 50. When the air current speed of the surface of the condensed water is increased, the evaporation amount of the condensed water may be increased. The forced air current generating apparatus 60 may be arranged to face the surface of the condensed water stored in the condensed water collecting apparatus 50, and accelerate evaporation of the condensed water.

The clothes care apparatus 1 according to an embodiment of the disclosure may improve an evaporation rate of the condensed water stored in the condensed water collecting apparatus 50 by including the forced air current generating apparatus 60 and the refrigerant pipe 45 in a high-temperature state, which corresponds to the condensed water heating apparatus.

In general, the evaporation rate is defined by an amount of water evaporated per hour. The evaporation rate may be proportional to an air current speed v around a water surface and proportional to a surface area of water. Also, the evaporation rate may increase as a temperature Twater of water is increased.

According to an embodiment of the disclosure, through an operation of the heat pump apparatus 40, a temperature of the condensed water may be increased through the refrigerant pipe 45 operating as the condensed water heating apparatus, and air flow may be induced around a surface of the condensed water through the forced air current generating apparatus 60. The forced air current generating apparatus 60 may increase the air current speed around the surface of the condensed water. In this case, the evaporation rate of the condensed water may be increased up to 10 times to 20 times compared to a natural evaporation rate, wherein there is no flow in ambient air of the surface of the condensed water and a temperature is similar to a temperature inside the machine room 30. For example, when the natural evaporation rate is about 10 g/h, the increased evaporation rate may be 100 g/h to 200 g/h.

The air circulation fan 70 may be provided between the heat pump apparatus 40 and the accommodating chamber 20 to circulate air. The air circulation fan 70 may rotate based on a pre-determined RPM. The air circulation fan 70 may suck up air introduced from the accommodating chamber 20 through to the air vent 31, and discharge the air that has passed through the heat pump apparatus 40 to the accommodating chamber 20 again.

The temperature sensor 120 may be variously arranged in the machine room 30, and measure an ambient temperature of the temperature sensor 120. For example, the temperature sensor 120 may be arranged close to the condensed water collecting apparatus 50 and measure an ambient temperature of the condensed water stored in the condensed water collecting apparatus 50. Information about the ambient temperature measured by the temperature sensor 120 may be transmitted to the processor 110. The processor 110 may operate in any one of various operating modes according to the ambient temperature measured by the temperature sensor 120. The processor 110 may control the heat pump apparatus 40 according to the operating mode. For example, the processor 110 may operate in a low-temperature mode, a room-temperature mode, or a high-temperature mode according to the ambient temperature.

The humidity sensor 130 may be variously arranged in the machine room 30, and measure ambient humidity of the humidity sensor 130. For example, the humidity sensor 130 may be arranged close to the condensed water collecting apparatus 50 and measure ambient humidity of the condensed water stored in the condensed water collecting apparatus 50. Information about the ambient humidity measured by the humidity sensor 130 may be transmitted to the processor 110. The processor 110 may operate in any one of various operating modes according to the ambient humidity measured by the humidity sensor 130. The processor 110 may control the heat pump apparatus 40 according to the operating mode.

The water level sensor 140 may measure a collected amount of the condensed water stored in the condensed water collecting apparatus 50. Information about the collected amount measured by the water level sensor 140 may be transmitted to the processor 110. The processor 110 may operate in any one of various operating modes according to the collected amount measured by the water level sensor 140. The processor 110 may control the heat pump apparatus 40 according to the operating mode. For example, the processor 110 may operate in an energy-saving mode, a basic mode, a condensed water overload operation, and an emergency operation, according to the measured collected amount.

The processor 110 may control the heat pump apparatus 40 and control the forced air current generating apparatus 60, according to the collected amount of the condensed water collecting apparatus 50, which is measured through the water level sensor 140. For example, when the collected amount is high, the heat pump apparatus 40 and the forced air current generating apparatus 60 may be controlled to be operated. For example, when the collected amount is low, the heat pump apparatus 40 may be controlled to be operated and the forced air current generating apparatus 60 may be controlled to be not operated. Various examples of a control method for the clothes care apparatus 1 will be described below with reference to FIGS. 11 through 15.

Figure 8:
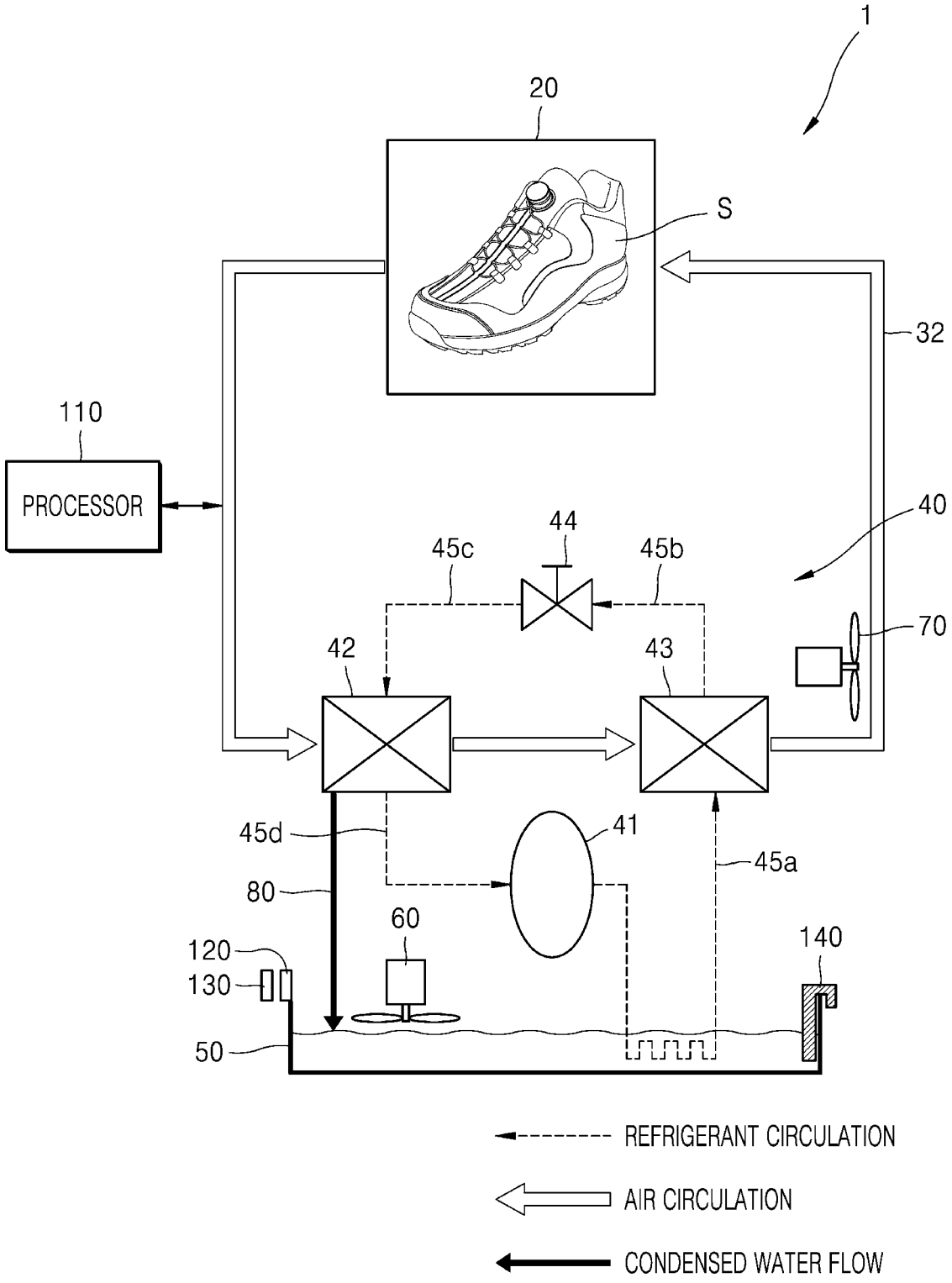
FIG. 8 is a schematic view of a heat pump apparatus and a condensed water collecting apparatus, which are applied to a clothes care apparatus, according to an embodiment of the disclosure.

FIG. 8 is a schematic view of a heat pump apparatus and a condensed water collecting apparatus, which are applied to a clothes care apparatus, according to an embodiment of the disclosure.

Referring to FIG. 8, the clothes care apparatus 1 according to an embodiment of the disclosure includes the accommodating chamber 20 for accommodating a target S, the heat pump apparatus 40 configured to dehumidify and heat the air in the accommodating chamber 20 to dry the target S, the condensed water collecting apparatus 50 configured to collect the condensed water generated in the heat pump apparatus 40, the forced air current generating apparatus 60 configured to generate the forced air current in the condensed water stored in the condensed water collecting apparatus 50, and the air circulation fan 70 provided between the heat pump apparatus 40 and the accommodating chamber 20 to circulate the air. Also, the clothes care apparatus 1 includes the processor 110 configured to control general operations of the clothes care apparatus 1, the temperature sensor 120 configured to measure the ambient temperature of the condensed water collecting apparatus 50, the humidity sensor 130 configured to measure the ambient humidity of the condensed water collecting apparatus 50, and the water level sensor 140 configured to measure the collected amount of the condensed water of the condensed water collecting apparatus 50.

The air in the accommodating chamber 20 may circulate through the air passage 32. The air in the accommodating chamber 20 may be dehumidified and heated while passing through the evaporator 42 and the condenser 43. Here, the air circulation fan 70 may induce air circulation in the air passage 32.

The heat pump apparatus 40 includes the compressor 41, the condenser 43, the expansion apparatus 44, and the evaporator 42. The compressor 41, the condenser 43, the expansion apparatus 44, and the evaporator 42 may be connected to each other by the refrigerant pipe 45 to configure a heat pump cycle. The refrigerant may circulate according to the heat pump cycle while flowing through the refrigerant pipe 45.

The refrigerant pipe 45 may include the first flow path 45*a*, the second flow path 45*b*, the third flow path 45*c*, and the fourth flow path 45*d*. The first flow path 45*a* may be a refrigerant pipe that transmits a gas-phase refrigerant of a high temperature and high pressure, which is discharged from the compressor 41, to the condenser 43. The second flow path 45*b* may be a refrigerant pipe that transmits a liquid-phase or near-liquid-phase refrigerant of high pressure, which is equal to or less than a condensation temperature, discharged from the condenser 43, to the expansion apparatus 44. The third flow path 45*c* may be a refrigerant pipe that transmits a two-phase refrigerant of a low temperature and low pressure, which is discharged from the expansion apparatus 44, to the evaporator 42. The fourth flow path 45*d* may be a refrigerant pipe that transmits a gas-phase refrigerant of a low temperature and low pressure, which is discharged from the evaporator 42, to the compressor 41.

The compressor 41 compresses the gas-phase refrigerant of a low temperature and low pressure, which flows through the fourth flow path 45*d*, and discharges the gas-phase refrigerant of a high temperature and high pressure. The discharged gas-phase refrigerant of the high temperature and high pressure is introduced to the condenser 43 through the first flow path 45*a*, and the gas-phase refrigerant of the high temperature and high pressure may be condensed to the liquid-phase or near-liquid-phase refrigerant of high pressure, which is equal to or less than the condensation temperature, by the condenser 43. The liquid-phase or near-liquid-phase refrigerant of the high pressure, which flows through the second flow path 45*b* after passing through the condenser 43, is decompressed through the expansion apparatus 44, and the two-phase refrigerant of a low temperature and low pressure, which passed through the expansion apparatus 44, is introduced to the evaporator 42 through the third flow path 45*c*. In the evaporator 42, the two-phase refrigerant may be evaporated to the gas-phase refrigerant. The gas-phase refrigerant may be discharged from the evaporator 42 through the fourth flow path 45*d*.

High-temperature humid air in the accommodating chamber 20 may exchange heat with the two-phase refrigerant of the low temperature and low pressure while passing through the evaporator 42. In detail, the two-phase refrigerant of the low temperature and low pressure, which is introduced to the evaporator 42 through the third flow path 45*c*, may absorb heat from the high-temperature humid air passing through the evaporator 42 and be evaporated as the gas-phase refrigerant, and the high-temperature humid air that passes through the evaporator 42 is cooled down and at the same time, dehumidified to become low-temperature dry air. The gas-phase refrigerant discharged from the evaporator 42 may flow through the fourth flow path 45*d*.

The low-temperature dry air that passed through the evaporator 42 may be introduced to the condenser 43, and the gas-phase refrigerant of the high temperature and high pressure and the low-temperature dry air may exchange heat in the condenser 43. In detail, the gas-phase refrigerant of the high temperature and high pressure, which is introduced to the condenser 43 through the first flow path 45*a*, may emit heat while being condensed to the liquid-phase or near-liquid-phase refrigerant, and the low-temperature dry air may be heated by absorbing the heat emitted during a refrigerant condensation process. The gas-phase refrigerant discharged from the condenser 43 may flow through the second flow path 45*b*.

According to an embodiment of the disclosure, the first flow path 45*a* that transmits, to the condenser 43, the gas-phase refrigerant of the high temperature and high pressure, which is discharged from the compressor 41, may be provided to pass through the inside of the condensed water collecting apparatus 50. When the first flow path 45*a* is provided to pass through the inside of the condensed water collecting apparatus 50, the heating of the condensed water stored in the condensed water collecting apparatus 50 may be accelerated, thereby increasing the evaporation amount of the condensed water.

The processor 110 may control the heat pump apparatus 40 to operate according to the operating course. When the heat pump apparatus 40 operates, the first flow path 45*a* may be used as the condensed water heating apparatus for heating the condensed water of the condensed water collecting apparatus 50, and thus the processor 110 may operate in the condensed water heating state.

Also, the processor 110 may control the heat pump apparatus 40 not to operate when a time of the operating course is completed or the operating course is temporarily stopped. When the heat pump apparatus 40 does not operate, the first flow path 45*a* is not used as the condensed water heating apparatus, and thus the processor 110 may operate in the condensed water heating stopped state.

The temperature sensor 120, the humidity sensor 130, and the water level sensor 140 may each be provided near the condensed water collecting apparatus 50.

Hereinafter, another example of the clothes care apparatus 1 according to an embodiment of the disclosure will be described with reference to FIGS. 9 and 10. Features of the clothes care apparatus 1 according to the present embodiment of the disclosure may be combined with the embodiment of the disclosure described above, unless such a combination leads to an obvious technical conflict.

Figure 9:
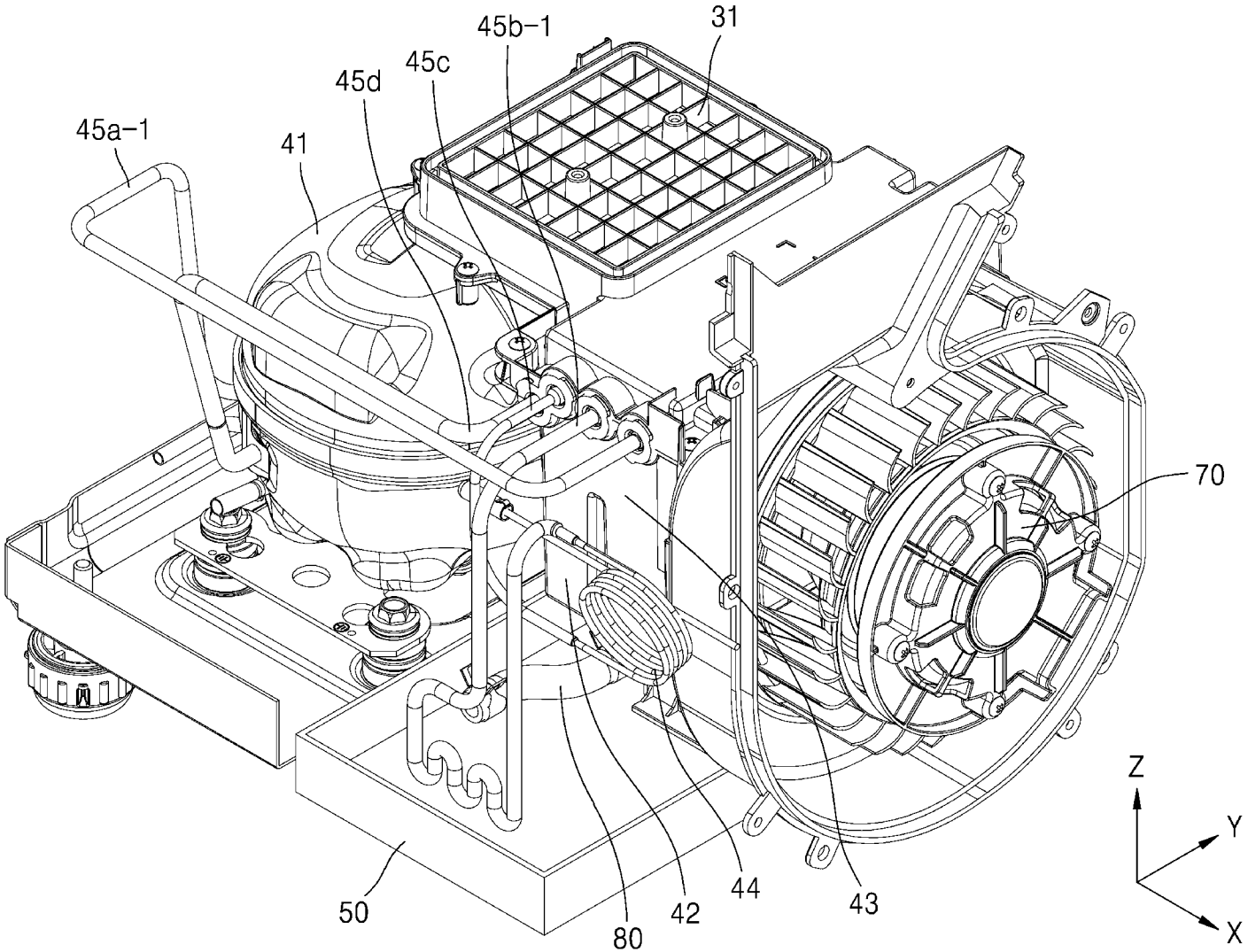
FIG. 9 is a perspective view of a heat pump apparatus applied to a clothes care apparatus, according to an embodiment of the disclosure.

FIG. 9 is a perspective view of a heat pump apparatus applied to a clothes care apparatus, according to an embodiment of the disclosure. FIG. 10 is a schematic view of a heat pump apparatus and a condensed water collecting apparatus, which are applied to a clothes care apparatus, according to an embodiment of the disclosure.

Figure 10:
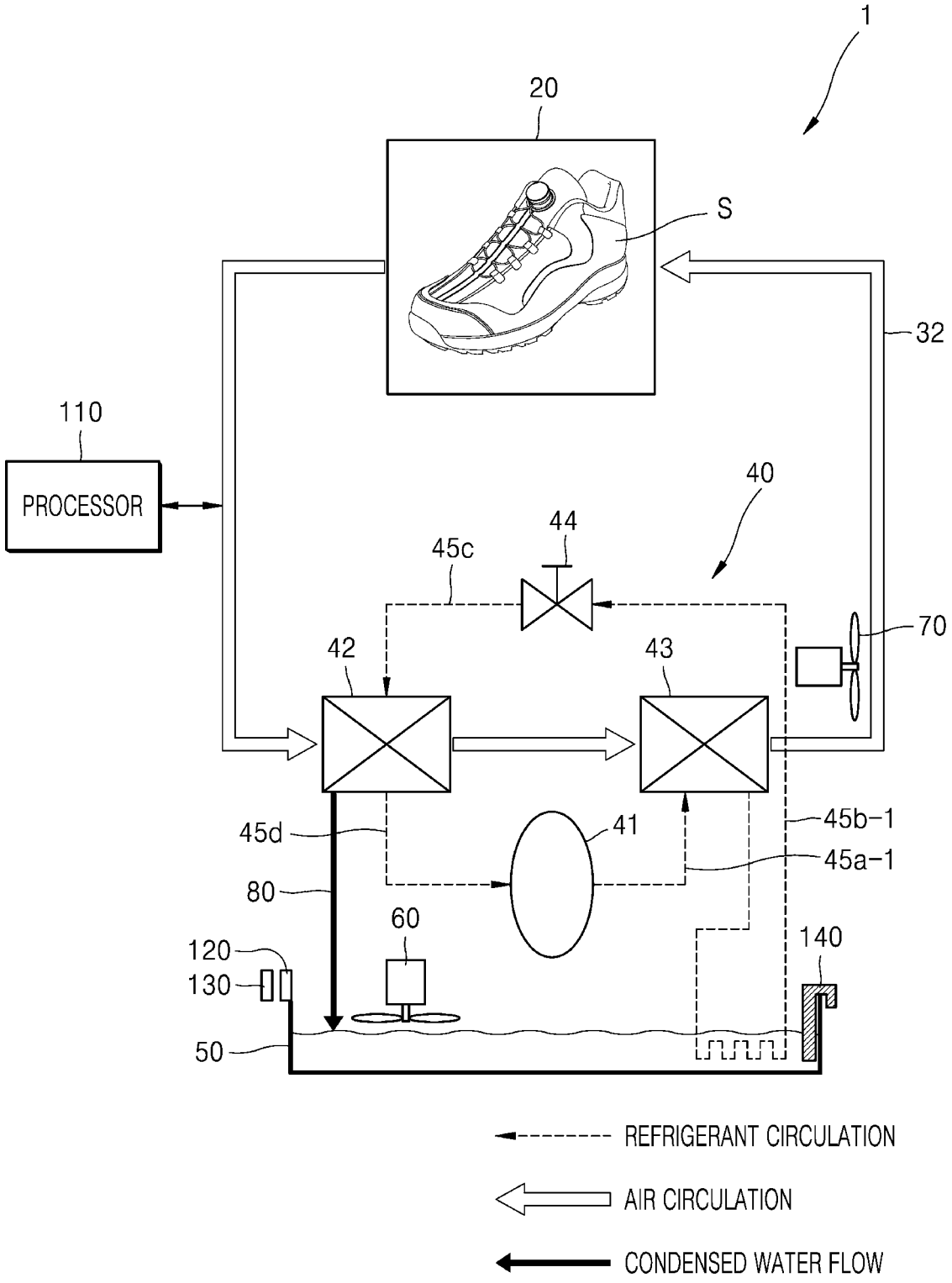
FIG. 10 is a schematic view of a heat pump apparatus and a condensed water collecting apparatus, which are applied to a clothes care apparatus, according to an embodiment of the disclosure.

Referring to FIGS. 9 and 10, the clothes care apparatus 1 according to an embodiment of the disclosure may include a second flow path 45*b*-1 provided to pass through the inside of the condensed water collecting apparatus 50.

The second flow path 45*b*-1 may pass through the condensed water storage space of the condensed water collecting apparatus 50, and correspond to the condensed water heating apparatus configured to heat the stored condensed water. The second flow path 45*b*-1 may be a refrigerant pipe that transmits the liquid-phase or near-liquid-phase refrigerant of high pressure, which is equal to or less than the condensation temperature, discharged from the condenser 43, to the expansion apparatus 44. A temperature of the refrigerant flowing through the second flow path 45*b*-1 may be lower than a temperature of the refrigerant flowing through a first flow path 45*a*-1, but may be higher than a temperature of the refrigerant flowing through the third flow path 45*c* or fourth flow path 45*d*. In other words, the second flow path 45*b*-1 may transmit the refrigerant of a relatively high temperature. For example, the temperature of the refrigerant flowing through the second flow path 45*b*-1 may be higher than a room temperature, but is not limited thereto.

When the clothes care apparatus 1 operates according to an operating mode, the refrigerant circulates through the refrigerant pipe 45 of the heat pump apparatus 40, and because the second flow path 45*b*-1 transmits the refrigerant of the relatively high temperature, the second flow path 45*b*-1 may itself be a pipe in a high-temperature state. A portion of the second flow path 45*b*-1, which passes through the condensed water storage space of the condensed water collecting apparatus 50, may heat and evaporate the condensed water with high-temperature heat.

For example, the second flow path 45*b*-1 may extend in the first direction (the X-axis direction) near a discharge port of the condenser 43 and a discharge port of the expansion apparatus 44, and then extend in the second direction (the Z-axis direction) perpendicular to the first direction (the X-axis direction) towards the condensed water collecting apparatus 50. The second flow path 45*b*-1 may be provided to pass through the condensed water storage space of the condensed water collecting apparatus 50. The portion of the second flow path 45*b*-1 which passes through the condensed water storage space of the condensed water collecting apparatus 50, may have a winding shape. Accordingly, a surface area of the second flow path 45*b*-1, which contacts the condensed water, may be increased, and thus heating and evaporating of the condensed water by the second flow path 45*b*-1 may be accelerated.

Meanwhile, according to an embodiment of the disclosure, the first flow path 45*a*-1 does not extend towards the condensed water collecting apparatus 50, and does not pass through the condensed water collecting apparatus 50, but is not limited thereto. For example, the first flow path 45*a*-1 may be provided to pass through the condensed water collecting apparatus 50, like the first flow path 45*a* of FIGS. 5 and 6.

Hereinafter, a control method for the clothes care apparatus 1, according to a value measured by the water level sensor 140, according to an embodiment of the disclosure, will be described with reference to FIGS. 11 through 13.

Figure 11:
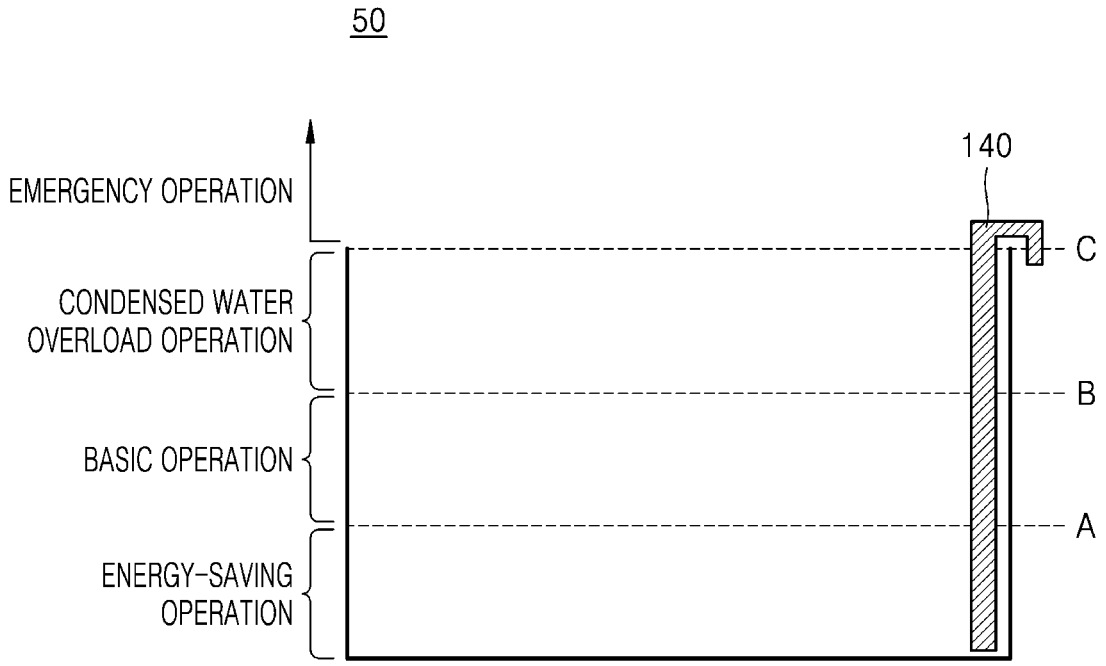
FIG. 11 is a schematic view of a condensed water collecting apparatus and a water level sensor of a clothes care apparatus, according to an embodiment of the disclosure.

FIG. 11 is a schematic view of a condensed water collecting apparatus and a water level sensor of a clothes care apparatus, according to an embodiment of the disclosure.

FIG. 12 is a table showing a process by which a clothes care apparatus selects an operating mode according to a collected amount of condensed water of a condensed water collecting apparatus, according to an embodiment of the disclosure.

Referring to FIGS. 11 and 12, the water level sensor 140 may measure the collected amount of the condensed water collected in the condensed water collecting apparatus 50. The processor 110 may control the operating mode of the clothes care apparatus 1, according to the collected amount of the condensed water collecting apparatus 50, which is measured by the water level sensor 140.

For example, the water level sensor 140 may transmit, to the processor 110, information about the measured collected amount. Upon receiving the measured collected amount, the processor 110 may compare the collected amount with a first reference water level A, a second reference water level B, or a threshold water level C. The processor 110 may control the operating mode of the clothes care apparatus 1, based on a result of comparing the collected amount with the first reference water level A, the second reference water level B, or the threshold water level C. For example, the operating mode may be one of the energy-saving mode, the basic mode, the condensed water overload operation, and the emergency operation.

According to an embodiment of the disclosure, the second reference water level B may be lower than the threshold water level C and higher than the first reference water level A. For example, the threshold water level C is a maximum water level of the condensed water accommodatable in the condensed water collecting apparatus 50, and when the collected amount is equal to or greater than the threshold water level C, the condensed water may overflow from the condensed water collecting apparatus 50. As another example, the threshold water level C may be present outside the condensed water collecting apparatus 50, and detect the condensed water overflowing from the condensed water collecting apparatus 50.

The processor 110 may normally operate the operating course of the clothes care apparatus 1 or temporarily stop the operating course, according to the operating mode. Also, the processor 110 may operate in the condensed water heating state or the condensed water heating stopped state, according to the operating mode. Also, the processor 110 may turn on or off power of the forced air current generating apparatus 60, according to the operating mode.

According to an embodiment of the disclosure, in response to determining that the collected amount is less than the first reference water level A, the processor 110 may control the clothes care apparatus 1 to be in the energy-saving mode. In the energy-saving mode, the processor 110 may control an operation of the heat pump apparatus 40 according to the selected operating course. In other words, the processor 110 may control the heat pump apparatus 40 to operate so as to be normally operated according to the selected operating course of the clothes care apparatus 1.

In the energy-saving mode, the processor 110 may operate in the condensed water heating state as the heat pump apparatus 40 is operated. In the condensed water heating state, at least one flow path, which transmits a refrigerant of a high-temperature state, among the refrigerant pipe 45, may pass through the inside of the condensed water collecting apparatus 50, thereby heating the condensed water. Also, the processor 110 may turn off the power of the forced air current generating apparatus 60. When it is determined that the water level of the collected condensed water is less than the first reference water level A, the processor 110 may control the forced air current generating apparatus 60 not to operate for energy saving. The condensed water less than the first reference water level A may be heated and evaporated by at least one flow path operating as the condensed water heating apparatus.

According to an embodiment of the disclosure, in response to determining that the collected amount is equal to or greater than the first reference water level A and less than the second reference water level B, the processor 110 may control the clothes care apparatus 1 to be in the basic mode. In the basic mode, the processor 110 may control the heat pump apparatus 40 to operate according to the selected operating course. The processor 110 may control the heat pump apparatus 40 to operate so as to be normally operated according to the selected operating course of the clothes care apparatus 1, as in the energy-saving mode.

In the basic mode, the processor 110 may operate in the condensed water heating state, and the at least one flow path, which transmits the refrigerant of the high-temperature state, among the refrigerant pipe 45, may heat the condensed water by passing through the inside of the condensed water collecting apparatus 50. Also, the processor 110 may turn on the power of the forced air current generating apparatus 60. When it is determined that the water level of the collected condensed water is equal to or greater than the first reference water level A and less than the second reference water level B, the processor 110 may control the forced air current generating apparatus 60 to operate. The condensed water equal to or greater than the first reference water level A and less than the second reference water level B may be heated by the at least one flow path operating as the condensed water heating apparatus, and evaporated by the forced air current of the forced air current generating apparatus 60.

According to an embodiment of the disclosure, in response to determining that the collected amount is equal to or greater than the second reference water level B and less than the threshold water level C, the processor 110 may control the clothes care apparatus 1 to the condensed water overload operation. In the condensed water overload operation, the processor 110 may control an operation of the heat pump apparatus 40 according to the selected operating course. The processor 110 may control the heat pump apparatus 40 to operate so as to be normally operated according to the selected operating course of the clothes care apparatus 1, as in the energy-saving mode.

In the condensed water overload operation, the processor 110 may operate in the condensed water heating state, and the at least one flow path, which transmits the refrigerant of the high-temperature state, among the refrigerant pipe 45, may heat the condensed water by passing through the inside of the condensed water collecting apparatus 50. Also, the processor 110 may turn on the power of the forced air current generating apparatus 60. When it is determined that the water level of the collected condensed water is equal to or greater than the second reference water level B and less than the threshold water level C, the processor 110 may control the forced air current generating apparatus 60 to operate.

According to an embodiment of the disclosure, the processor 110 may increase a rotating speed of a fan of the forced air current generating apparatus 60 in the condensed water overload operation, compared to the basic mode. By increasing the rotating speed of the fan, the processor 110 may increase an evaporation speed of the condensed water.

Meanwhile, in the condensed water overload operation, even after a time of the operating course is completed, the processor 110 may turn on the power of the forced air current generating apparatus 60 until the collected amount of the condensed water reaches the second reference water level B. The forced air current generating apparatus 60 may generate the forced air current on the surface of the condensed water so that the collected condensed water is evaporated up to the second reference water level B. When the time of the operating course is completed, the processor 110 no longer operates the heat pump apparatus 40, and thus the at least one flow path may no longer heat the condensed water. Accordingly, the processor 110 may operate in the condensed water heating stopped state.

According to an embodiment of the disclosure, in response to determining that the collected amount is equal to or greater than the threshold water level C, the processor 110 may control the clothes care apparatus 1 to the emergency operation. In the emergency operation, the processor 110 may temporarily stop the operating course of the clothes care apparatus 1 so as to prevent the condensed water stored in the condensed water collecting apparatus 50 from overflowing. When the operating course is proceeded, the condensed water is continuously generated according to the operation of the heat pump apparatus 40, and thus the processor 110 may temporarily stop the operation so as to control the heat pump apparatus 40 not to operate. The processor 110 may evaporate the condensed water through the forced air current generating apparatus 60.

In the emergency operation, the processor 110 may stop the operating course until the collected amount of the condensed water reaches the threshold water level C, and operate the forced air current generating apparatus 60 to accelerate the evaporation of the condensed water. Because the processor 110 does not operate the heat pump apparatus 40, the at least one flow path may not heat the condensed water. Accordingly, the processor 110 may operate in the condensed water heating stopped state.

According to an embodiment of the disclosure, the rotating speed of the fan of the forced air current generating apparatus 60 in the emergency operation may be the same as or greater than that in the condensed water overload operation.

According to an embodiment of the disclosure, the clothes care apparatus 1 may measure the collected amount of the condensed water stored in the condensed water collecting apparatus 50 to adjust the evaporation amount of the condensed water according to situations. When the collected amount of the condensed water is relatively low, the forced air current generating apparatus 60 may not be operated to save energy. When the collected amount of the condensed water is relatively high, the forced air current generating apparatus 60 may be operated even after the operating course is completed or temporarily stopped, so as to increase the evaporation amount of the condensed water.

According to an embodiment of the disclosure, at least one of the energy-saving mode, the basic mode, the condensed water overload operation, or the emergency operation may be omitted. For example, when there is no water level sensor 140 detecting the first reference water level A, the energy-saving mode may be omitted and the processor 110 may perform control according to the basic mode. Also, for example, when there is no water level sensor 140, the processor 110 may operate only in the basic mode. In this case, the condensed water may overflow from the condensed water collecting apparatus 50, and thus caution is required. Also, for example, when there is only the water level sensor 140 detecting the threshold water level C, the processor 110 may operate only in the basic mode and the emergency operation, and the energy-saving mode and the condensed water overload operation may be omitted.

Figure 13:
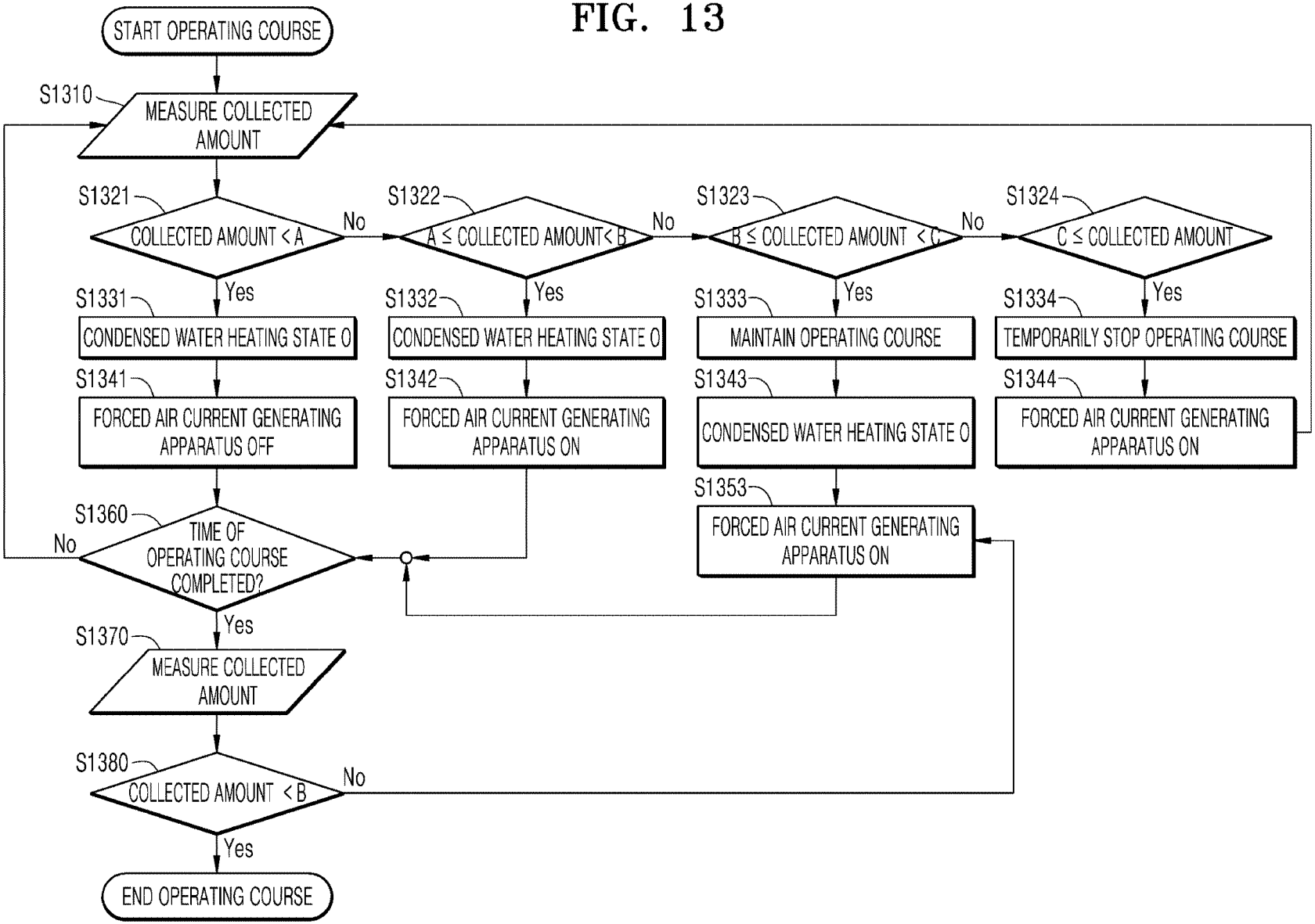
FIG. 13 is a flowchart of a process for selecting an operating mode according to FIG. 12.

FIG. 13 is a flowchart of a process for selecting an operating mode according to FIG. 12.

In operation S1310, the processor 110 may measure the collected amount of the condensed water stored in the condensed water collecting apparatus 50, through the water level sensor 140. The processor 110 may compare the collected amount with the first reference water level A, the second reference water level B, or the threshold water level C. The processor 110 may control the operating mode of the clothes care apparatus 1, the condensed water heating state, and a forced air current generating apparatus operation, based on the result of comparing the collected amount with the first reference water level A, the second reference water level B, or the threshold water level C.

In operation S1321, the processor 110 may determine whether the collected amount is less than the first reference water level A. In response to determining that the collected amount is less than the first reference water level A, the processor 110 may perform operations S1331 and S1341. The clothes care apparatus 1 may perform the energy-saving mode according to operations S1331 and S1341.

When it is determined that the collected amount is equal to or greater than the first reference water level A, the processor 110 may perform one of operations S1322, S1323, and S1324.

In operation S1322, the processor 110 may determine whether the collected amount is equal to or greater than the first reference water level A and less than the second reference water level B. In response to determining that the collected amount is equal to or greater than the first reference water level A and less than the second reference water level B, the processor 110 may perform operations S1332 and S1342. The clothes care apparatus 1 may perform the basic mode according to operations S1332 and S1342.

When it is determined that the collected amount is equal to or greater than the second reference water level B, the processor 110 may perform one of operations S1323 and S1324.

In operation S1323, the processor 110 may determine whether the collected amount is equal to or greater than the second reference water level B and less than the threshold water level C. In response to determining that the collected amount is equal to or greater than the second reference water level B and less than the threshold water level C, the processor 110 may perform operations S1333, S1343, and S1353. The clothes care apparatus 1 may perform the condensed water overload operation according to operations S1333, S1343, and S1353.

When it is determined that the collected amount is equal to or greater than the threshold water level C, the processor 110 may perform operation S1324.

In response to determining that the collected amount is equal to or greater than the threshold water level C in operation S1324, the processor 110 may perform operations S1334 and S1344. The clothes care apparatus 1 may perform the emergency operation according to operations S1334 and S1344.

In operation S1331, the processor 110 may operate in the condensed water heating state, according to the energy-saving mode. The processor 110 may control the heat pump apparatus 40 to operate so as to be normally operated according to the selected operating course of the clothes care apparatus 1. In the condensed water heating state, the at least one flow path, which transmits the refrigerant of the high-temperature state, among the refrigerant pipe 45, may pass through the inside of the condensed water collecting apparatus 50, thereby heating the condensed water.

In operation S1341, the processor 110 may turn off the power of the forced air current generating apparatus 60, according to the energy-saving mode. When the collected amount of the condensed water is relatively low, the processor 110 may not operate the forced air current generating apparatus 60 to save energy.

When it is determined that the collected amount of the condensed water is less than the first reference water level A, the clothes care apparatus 1 may heat and evaporate the condensed water according to the at least one flow path operating as the condensed water heating apparatus.

In operation S1332, the processor 110 may operate in the condensed water heating state, according to the basic mode. The processor 110 may control the heat pump apparatus 40 to operate so as to be normally operated according to the selected operating course of the clothes care apparatus 1. In the condensed water heating state, the at least one flow path, which transmits the refrigerant of the high-temperature state, among the refrigerant pipe 45, may pass through the inside of the condensed water collecting apparatus 50, thereby heating the condensed water.

In operation S1342, the processor 110 may turn on the power of the forced air current generating apparatus 60, according to the basic mode. The processor 110 may operate the forced air current generating apparatus 60 to basically increase the evaporation amount of the condensed water.

When it is determined that the collected amount of the condensed water is equal to or greater than the first reference water level A and less than the second reference water level B, the clothes care apparatus 1 may heat and evaporate the condensed water by the at least one flow path operating as the condensed water heating apparatus, and evaporate the condensed water by the forced air current of the forced air current generating apparatus 60.

In operation S1333, the processor 110 may maintain the selected operating course of the clothes care apparatus 1, according to the condensed water overload operation.

In operation S1343, the processor 110 may operate in the condensed water heating state, according to the condensed water overload operation. The heat pump apparatus 40 may be operated by the processor 110, and the at least one flow path, which transmits the refrigerant of the high-temperature state, among the refrigerant pipe 45, may heat the condensed water by passing through the inside of the condensed water collecting apparatus 50.

In operation S1353, the processor 110 may turn on the power of the forced air current generating apparatus 60, according to the condensed water overload operation. The processor 110 may operate the forced air current generating apparatus 60 to increase the evaporation amount of the condensed water.

Meanwhile, when it is determined that the collected amount is equal to or greater than the second reference water level B even after the time of the operating course is completed, in operation S1380, the processor 110 may control operation S1353 to be continuously performed. Even after the time of the operating course is completed, the processor 110 may turn on the power of the forced air current generating apparatus 60 until the collected amount of the condensed water reaches the second reference water level B.

When it is determined that the collected amount of the condensed water is equal to or greater than the second reference water level B and less than the threshold water level C, the clothes care apparatus 1 may heat and evaporate the condensed water by the at least one flow path operating as the condensed water heating apparatus, and evaporate the condensed water by the forced air current of the forced air current generating apparatus 60. Even after the time of the operating course is completed, the clothes care apparatus 1 may evaporate the condensed water by the forced air current of the forced air current generating apparatus 60 until the collected amount of the condensed water reaches the second reference water level B.

In operation S1334, the processor 110 may temporarily stop the operating course of the clothes care apparatus 1, according to the emergency operation. The processor 110 may temporarily stop the operation and control the heat pump apparatus 40 to not operate, so as to prevent the condensed water stored in the condensed water collecting apparatus 50 from overflowing. When the operation of the heat pump apparatus 40 is stopped, the at least one flow path does not operate as the condensed water heating apparatus, and thus the condensed water may not be heated. Accordingly, the processor 110 may operate in the condensed water heating stopped state.

In operation S1344, the processor 110 may turn on the power of the forced air current generating apparatus 60, according to the emergency operation. The processor 110 may operate the forced air current generating apparatus 60 to increase the evaporation amount of the condensed water.

Meanwhile, in operations S1344 and S1310, the processor 110 may measure the collected amount of the condensed water again through the water level sensor 140. When it is still determined that the collected amount of the condensed water is equal to or greater than the threshold water level C (operation S1324), the processor 110 may temporarily stop the operating course (operation S1334), and operate only the forced air current generating apparatus 60 (operation S1344). When it is determined that the collected amount of the condensed water, which is measured again, is less than the threshold water level C, the processor 110 may resume the operating course (operations S1321, S1322, or S1323).

In operation S1360, the processor 110 may determine whether the time of the operating course is completed. Each operating course has a determined time, and thus when it is determined that the time of the selected operating course is completed, the processor 110 may perform operations S1370 and S1380. When it is determined that the determined time is not completed, the processor 110 may measure the collected amount of the condensed water again in operation S1310, and compare the collected amount with the first reference water level A, the second reference water level B, or the threshold water level C.

When it is determined that the determined time is completed, the processor 110 may measure the collected amount of the condensed water stored in the condensed water collecting apparatus 50, in operation S1370.

In operation S1380, the processor 110 may determine whether the collected amount is less than the second reference water level B. When it is determined that the collected amount is equal to or greater than the second reference water level B, the processor 110 may turn on the power of the forced air current generating apparatus 60 in operation S1353, even after the time of the operating course is completed. As a part of the condensed water overload operation, the processor 110 may generate the forced air current on the surface of the condensed water and increase the evaporation amount of the condensed water until the collected amount of the condensed water reaches the second reference water level B.

When it is determined that the collected amount is less than the second reference water level B, the processor 110 may complete the operating course.

According to an embodiment of the disclosure, the clothes care apparatus 1 may evaporate the condensed water stored in the condensed water collecting apparatus 50, as the operating course is proceeded. The evaporation amount of the condensed water may be adjusted according to the collected amount measured by the water level sensor 140.

Hereinafter, a control method for the clothes care apparatus 1, according to a value measured by the temperature sensor 120 and the humidity sensor 130, according to an embodiment of the disclosure, will be described with reference to FIGS. 14 and 15.

FIG. 14 is a table showing a process by which a clothes care apparatus selects an operating mode according to an ambient temperature and ambient humidity of a condensed water collecting apparatus, according to an embodiment of the disclosure.

Referring to FIG. 14, the temperature sensor 120 may measure an ambient temperature of the condensed water collecting apparatus 50, and the humidity sensor 130 may measure ambient humidity of the condensed water collecting apparatus 50. The processor 110 may control the operating mode of the clothes care apparatus 1, according to the ambient temperature and ambient humidity measured by the temperature sensor 120 and humidity sensor 130.

According to an embodiment of the disclosure, the processor 110 may operate in a low-temperature mode when it is determined that the ambient temperature measured by the temperature sensor 120 is less than a first reference temperature X. In the low-temperature mode, the processor 110 may turn on the power of the forced air current generating apparatus 60, regardless of the measured ambient humidity. In the low-temperature mode, the processor 110 operates the heat pump apparatus 40 according to the selected operating course, and thus the at least one flow path transmitting the refrigerant of the high-temperature state may operate as the condensed water heating apparatus. Accordingly, the processor 110 may operate in the condensed water heating state.

According to an embodiment of the disclosure, the processor 110 may control the operation of the forced air current generating apparatus 60, based on the ambient humidity measured by the humidity sensor 130, when the ambient temperature measured by the temperature sensor 120 is relatively high. The processor 110 operates the heat pump apparatus 40 according to the selected operating course, and thus may operate in the condensed water heating state.

For example, the processor 110 may operate in a room-temperature mode when it is determined that the ambient temperature measured by the temperature sensor 120 is equal to or greater than the first reference temperature X. In the room-temperature mode, the processor 110 may control the operation of the forced air current generating apparatus 60, based on the ambient humidity measured by the humidity sensor 130. For example, when the ambient humidity is less than a first reference humidity a, the processor 110 may turn off the power of the forced air current generating apparatus 60. Also, for example, when the ambient humidity is equal to or greater than the first reference humidity a, the processor 110 may turn on the power of the forced air current generating apparatus 60.

Also, for example, the processor 110 may operate in a high-temperature mode when it is determined that the ambient temperature measured by the temperature sensor 120 is equal to or greater than a second reference temperature Y. In the high-temperature mode, the processor 110 may control the operation of the forced air current generating apparatus 60, based on the ambient humidity measured by the humidity sensor 130. For example, when the ambient humidity is less than a second reference humidity 13, the processor 110 may turn off the power of the forced air current generating apparatus 60. Also, for example, when the ambient humidity is equal to or greater than the second reference humidity (3, the processor 110 may turn on the power of the forced air current generating apparatus 60.

In other words, even when the ambient temperature is relatively high, the forced air current generating apparatus 60 may not be operated when humidity is not high, so as to save energy. At this time, the condensed water may be heated and evaporated only through the at least one flow path operating as the condensed water heating apparatus by the heat pump apparatus 40. Also, when the ambient temperature is relatively high and the humidity is high, the forced air current generating apparatus 60 may be operated to increase the evaporation amount of the condensed water. At this time as well, the processor 110 may operate in the condensed water heating state.

Figure 15:
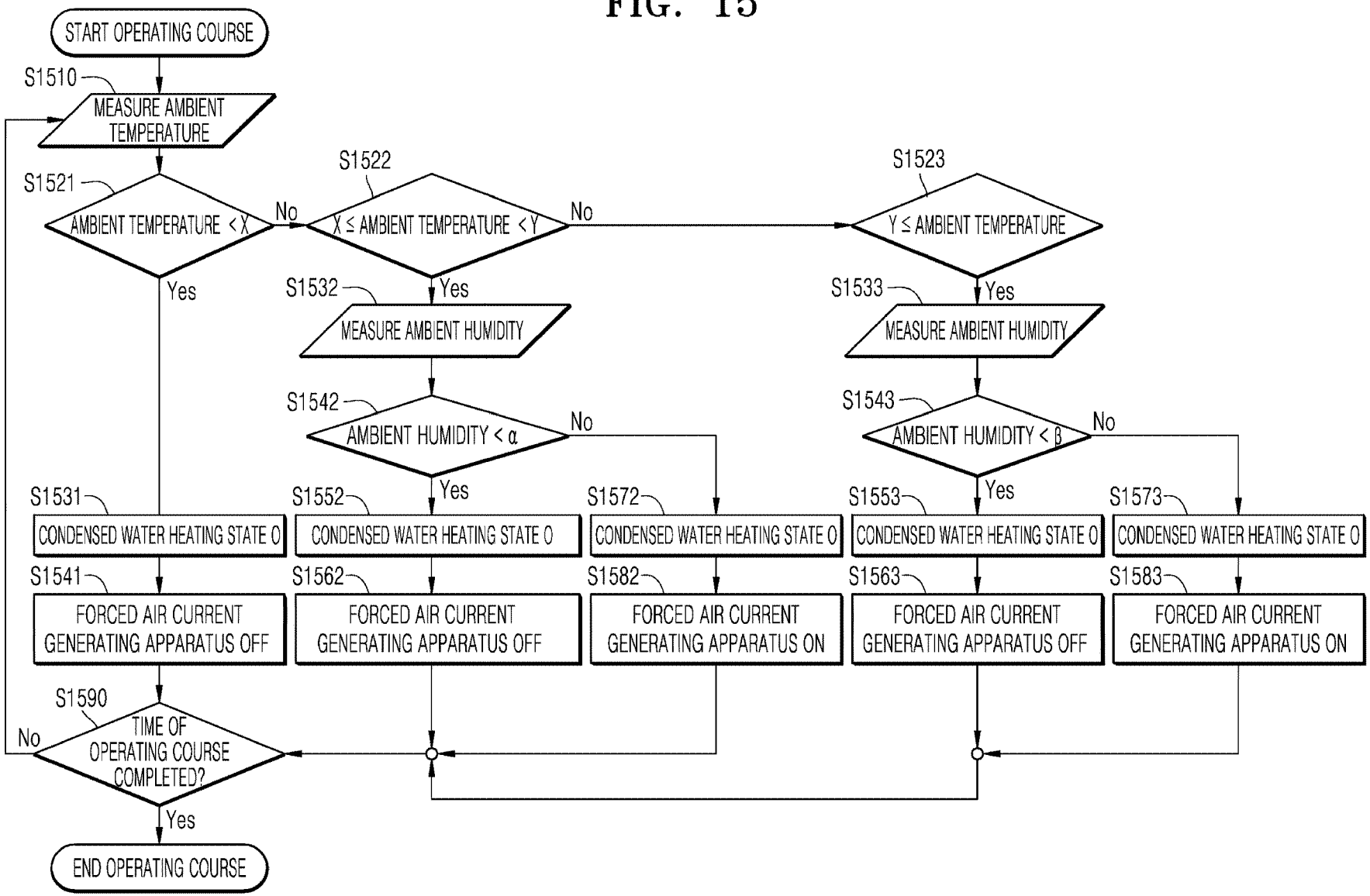
FIG. 15 is a flowchart of a process for selecting an operating mode according to FIG. 14.

FIG. 15 is a flowchart of a process for selecting an operating mode according to FIG. 14.

In operation S1510, the processor 110 may measure the ambient temperature of the condensed water collecting apparatus 50 through the temperature sensor 120. The processor 110 may compare the ambient temperature with the first reference temperature X or the second reference temperature Y.

In operation S1521, the processor 110 may determine whether the ambient temperature measured by the temperature sensor 120 is less than the first reference temperature X. In response to determining that the measured ambient temperature is less than the first reference temperature X, the processor 110 may perform operations S1531 and S1541. The processor 110 may perform the low-temperature mode according to operations S1531 and S1541.

In operation S1522, the processor 110 may determine whether the ambient temperature measured by the temperature sensor 120 is equal to or greater than the first reference temperature X and less than the second reference temperature Y. In response to determining that the measured ambient temperature is equal to or greater than the first reference temperature X and less than the second reference temperature Y, the processor 110 may perform operation S1532. The processor 110 may perform the room-temperature mode according to operation S1532.

In operation S1523, the processor 110 may determine whether the ambient temperature measured by the temperature sensor 120 is equal to or greater than the second reference temperature Y. In response to determining that the measured ambient temperature is equal to or greater than the second reference temperature Y, the processor 110 may perform operation S1533. The processor 110 may perform the high-temperature mode according to operation S1533. In operation S1531, the processor 110 operates the heat pump apparatus 40 according to the selected operating course, and thus the at least one flow path transmitting the refrigerant of the high-temperature state operates as the condensed water heating apparatus. Accordingly, the processor 110 may operate in the condensed water heating state. Also, in response to determining that the measured ambient temperature is less than the first reference temperature X, the processor 110 may turn off the forced air current generating apparatus 60 in operation S1541.

In response to determining that the measured ambient temperature is equal to or greater than the first reference temperature X and less than the second reference temperature Y, the processor 110 may measure the ambient humidity of the condensed water collecting apparatus 50 through the humidity sensor 130, in operation S1532. The processor 110 may compare the ambient humidity with the first reference humidity a.

In operation S1542, the processor 110 may determine whether the ambient humidity measured by the humidity sensor 130 is less than the first reference humidity a. When the ambient humidity is less than the first reference humidity a, the processor 110 may perform operations S1552 and S1562. When the ambient humidity is equal to or greater than the first reference humidity a, the processor 110 may perform operations S1572 and S1582.

In response to determining that the ambient humidity is less than the first reference humidity a, the processor 110 may operate in the condensed water heating state, in operation S1552. The processor 110 operates the heat pump apparatus 40 according to the selected operating course, and thus the at least one flow path transmitting the refrigerant of the high-temperature state may operate as the condensed water heating apparatus.

In response to determining that the ambient humidity is less than the first reference humidity a, the processor 110 may turn off the power of the forced air current generating apparatus 60, in operation S1562.

In the clothes care apparatus 1 according to an embodiment of the disclosure, even when the ambient temperature of the condensed water collecting apparatus 50 is a room temperature, the stored condensed water may be sufficiently evaporated by the at least one flow path transmitting the refrigerant of the high-temperature state, when the ambient humidity is relatively low. Accordingly, energy consumption of the clothes care apparatus 1 may be minimized.

In response to determining that the ambient humidity is equal to or greater than the first reference humidity a, the processor 110 may operate in the condensed water heating state, in operation S1572. The processor 110 operates the heat pump apparatus 40 according to the selected operating course, and thus the at least one flow path transmitting the refrigerant of the high-temperature state may operate as the condensed water heating apparatus.

In response to determining that the ambient humidity is equal to or greater than the first reference humidity a, the processor 110 may turn on the power of the forced air current generating apparatus 60, in operation S1582.

In the clothes care apparatus 1 according to an embodiment of the disclosure, when the ambient temperature of the condensed water collecting apparatus 50 is a room temperature and the ambient humidity is relatively high, the evaporation amount of the condensed water may be increased through the forced air current generating apparatus 60 and the at least one flow path transmitting the refrigerant of the high-temperature state.

In response to determining that the measured ambient temperature is equal to or greater than the second reference temperature Y, the processor 110 may measure the ambient humidity of the condensed water collecting apparatus 50 through the humidity sensor 130, in operation S1533. The processor 110 may compare the ambient humidity with the second reference humidity 13.

In operation S1543, the processor 110 may determine whether the ambient humidity measured by the humidity sensor 130 is less than the second reference humidity 13. When the ambient humidity is less than the second reference humidity (3, the processor 110 may perform operations S1553 and S1563. When the ambient humidity is equal to or greater than the second reference humidity (3, the processor 110 may perform operations S1573 and S1583.

In response to determining that the ambient humidity is less than the second reference humidity (3, the processor 110 may operate in the condensed water heating state, in operation S1553. The processor 110 operates the heat pump apparatus 40 according to the selected operating course, and thus the at least one flow path transmitting the refrigerant of the high-temperature state may operate as the condensed water heating apparatus.

In response to determining that the ambient humidity is less than the second reference humidity 13, the processor 110 may turn off the power of the forced air current generating apparatus 60, in operation S1563.

In the clothes care apparatus 1 according to an embodiment of the disclosure, even when the ambient temperature of the condensed water collecting apparatus 50 is a high temperature, the stored condensed water may be sufficiently evaporated by the at least one flow path transmitting the refrigerant of the high-temperature state, when the ambient humidity is relatively low. Accordingly, energy consumption of the clothes care apparatus 1 may be minimized.

In response to determining that the ambient humidity is equal to or greater than the second reference humidity 13, the processor 110 may operate in the condensed water heating state, in operation S1573. The processor 110 operates the heat pump apparatus 40 according to the selected operating course, and thus the at least one flow path transmitting the refrigerant of the high-temperature state may operate as the condensed water heating apparatus.

In response to determining that the ambient humidity is equal to or greater than the second reference humidity 13, the processor 110 may turn on the power of the forced air current generating apparatus 60, in operation S1583.

In the clothes care apparatus 1 according to an embodiment of the disclosure, when the ambient temperature of the condensed water collecting apparatus 50 is a high temperature and the ambient humidity is relatively high, the evaporation amount of the condensed water may be increased through the forced air current generating apparatus 60 and the at least one flow path transmitting the refrigerant of the high-temperature state.

In operation S1590, the processor 110 may determine whether the time of the operating course is completed. When it is determined that the time of the operating course is completed, the processor 110 may complete the operating course. When it is determined that the time of the operating course is not completed, the processor 110 may measure the ambient temperature of the condensed water collecting apparatus 50 again in operation S1510.

Figure 16:
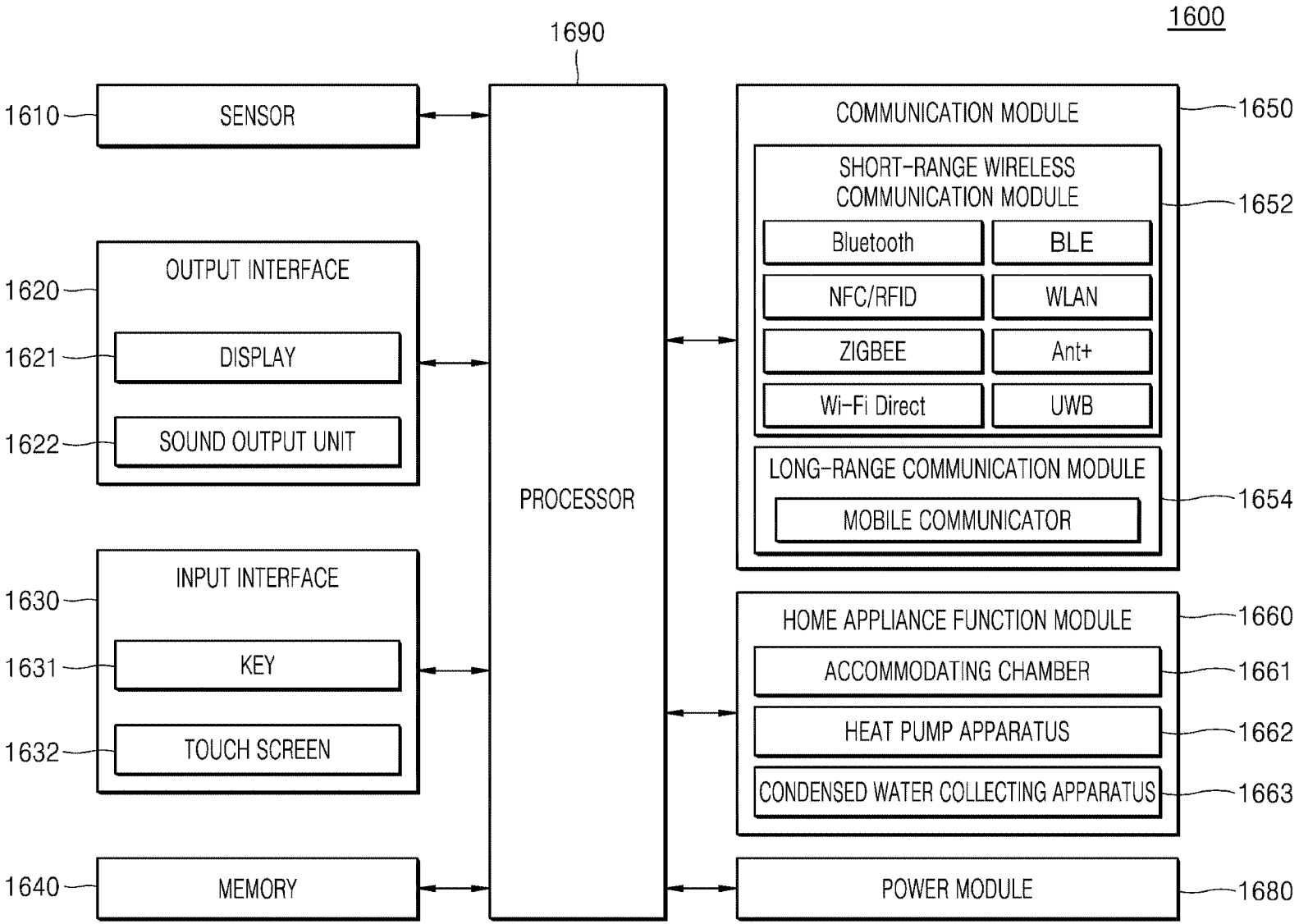
FIG. 16 is a block diagram of a structure of a clothes care apparatus, according to an embodiment of the disclosure.

FIG. 16 is a block diagram of a structure of a clothes care apparatus, according to an embodiment of the disclosure.

The clothes care apparatus 1 according to an embodiment of the disclosure may correspond to a clothes care apparatus 1600. The clothes care apparatus 1600 according to an embodiment of the disclosure includes a sensor 1610, an output interface 1620, an input interface 1630, a memory 1640, a communication module 1650, a home appliance function module 1660, a power module 1680, and a processor 1690. The clothes care apparatus 1600 may be configured in various combinations of the components shown in FIG. 16, and the components shown in FIG. 16 are not all essential components.

The clothes care apparatus 1600 of FIG. 16 corresponds to the clothes care apparatus 1 described with reference to FIG. 2, the processor 1690 corresponds to the processor 110 described with reference to FIG. 2, an accommodating chamber 1661 corresponds to the accommodating chamber 20 described with reference to FIG. 2, a heat pump apparatus 1662 corresponds to the heat pump apparatus 40 described with reference to FIG. 2, and a condensed water collecting apparatus 1663 corresponds to the condensed water collecting apparatus 50 described with reference to FIG. 2.

The sensor 1610 may include various types of sensors, and for example, the sensor 1610 may include various types of sensors, such as an image sensor, an infrared sensor, an ultrasonic sensor, a radar sensor, a recognition/detection sensor, a movement detection sensor, a proximity sensor, an illumination sensor, and the like. Because functions of each sensor can be intuitively inferred by one of ordinary skill in the art from the name, detailed descriptions thereof will be omitted.

The output interface 1620 may include a display 1621, a sound output unit 1622, and the like. The output interface 1620 outputs various notifications, messages, and information generated by the processor 1690.

The input interface 1630 may include a key 1631, a touch screen 1632, and the like. The input interface 1630 receives a user input and transmits the same to the processor 1690.

The memory 1640 stores various types of information, data, instructions, programs, and the like used for operations of the clothes care apparatus 1600. The memory 1640 may be configured in at least one of a volatile memory or a nonvolatile memory, or a combination thereof. The memory 1640 may include at least one type of storage medium among a flash memory type, a hard disk type, a multimedia card micro type, a card type memory (for example, a secure digital (SD) or an extreme digital (XD) memory), a random access memory (RAM), a static RAM (SRAM), a read-only memory (ROM), an electrically erasable programmable ROM (EEPROM), a programmable ROM (PROM), a magnetic memory, a magnetic disk, and an optical disk. Also, the clothes care apparatus 1600 may operate a web storage or cloud server performing a storing function on the Internet.

The communication module 1650 may include at least one or a combination of a short-range wireless communication module 1652 or a long-range communication module 1654. The communication module 1650 may include at least one antenna for communicating with another device wirelessly.

The short-range wireless communication module 1652 may include a Bluetooth communication module, a Bluetooth low energy (BLE) communication module, a near field communication module, a wireless local area network (WLAN) (Wi-Fi) communication module, a Zigbee communication module, an infrared data association (IrDA) communication module, a Wi-Fi direct (WFD) communication module, an ultra-wideband (UWB) communication module, and an Ant+ communication module, but is not limited thereto.

The long-range communication module 1654 may include a communication module performing various types of long-range communication, and may include a mobile communicator. The mobile communicator may transmit or receive a wireless signal to or from at least one of a base station, an external terminal, or a server, on a mobile communication network. Here, the wireless signal may include various types of data according to exchange of a voice call signal, an image call signal, or a text/multimedia message.

The home appliance function module 1660 includes an operation module that performs an intrinsic function of the clothes care apparatus 1600. The home appliance function module 1660 may include the accommodating chamber 1661, the heat pump apparatus 1662, and the condensed water collecting apparatus 1663.

The power module 1680 may be connected to a power source to supply power to the clothes care apparatus 1600.

The processor 1690 controls all operations of the clothes care apparatus 1600. The processor 1690 may control the components of the clothes care apparatus 1600 by executing a program stored in the memory 1640.

According to an embodiment of the disclosure, the processor 1690 may include a separate neural processing unit (NPU) performing an operation of an artificial intelligence model. In addition, the processor 1690 may include a central processing unit (GPU), a graphics processing unit (GPU), and the like.

The clothes care apparatus 1 according to an embodiment of the disclosure includes the accommodating chamber 20 accommodating the target, the heat pump apparatus 40 connected to the refrigerant pipe 45 in which the refrigerant circulates, and including the compressor 41, the condenser 43, the expansion apparatus 44, and the evaporator 42, the condensed water collecting apparatus 50 configured to collect the condensed water generated from the heat pump apparatus 40, and the processor 110 configured to control the heat pump apparatus 40, based on selection on an operating course for taking care of the target. The at least one flow path for transmitting the refrigerant of the high-temperature state, among the refrigerant pipe 45 of the heat pump apparatus 40, passes through a storage space of the condensed water stored in the condensed water collecting apparatus 50.

A clothes care apparatus according to an embodiment of the disclosure may heat condensed water stored in a condensed water collecting apparatus by passing at least one flow path transmitting a refrigerant of a high-temperature state among a refrigerant pipe of a heat pump apparatus through the condensed water collecting apparatus. Also, a clothes care apparatus according to an embodiment of the disclosure may improve user convenience because a process by which a user periodically discharges condensed water is omitted as evaporation of the condensed water heated by at least one flow path is accelerated. In addition, a clothes care apparatus according to an embodiment of the disclosure may not require an additional pipe for discharging condensed water stored in a condensed water collecting apparatus, as a portion of a refrigerant pipe operates as a condensed water heating apparatus.

The at least one flow path may be the refrigerant pipe 45 for transmitting the refrigerant of the high-temperature state, discharged from the compressor 41, to the condenser 43.

The at least one flow path may be the refrigerant pipe 45 for transmitting the refrigerant of the high-temperature state, discharged from the condenser 43, to the expansion apparatus 44.

A portion of the at least one flow path, which passes through the storage space of the condensed water collecting apparatus 50, may have a winding shape.

The clothes care apparatus 1 may further include the forced air current generating apparatus 60 configured to generate the forced air current in the condensed water collecting apparatus 50. The forced air current generating apparatus 60 may be arranged to face a surface of the condensed water stored in the condensed water collecting apparatus 50.

The clothes care apparatus 1 may further include the at least one water level sensor 140 configured to measure the collected amount of the condensed water collected in the condensed water collecting apparatus 50. The processor 110 may be further configured to control the operation of the heat pump apparatus 40 according to a selected operating course, in response to determining that the collected amount measured by the at least one water level sensor 140 is less than the threshold water level C, and operate in the condensed water heating state for heating the condensed water stored in the condensed water collecting apparatus 50 through the at least one flow path.

The processor 110 may be further configured to control the operation of the selected operating course to be stopped, in response to determining that the collected amount is equal to or greater than the threshold water level C, and operate in the condensed water heating stopped state, based on the stopping of the operating course.

The clothes care apparatus 1 may further include the at least one water level sensor 140 configured to measure the collected amount of the condensed water collected in the condensed water collecting apparatus 50. The processor 110 may be further configured to control the forced air current generating apparatus 60, based on a result of comparing the collected amount measured by the at least one water level sensor 140 and the first reference water level A.

The processor 110 may be further configured to control the power of the forced air current generating apparatus 60 to be turned on, in response to determining that the collected amount measured by the at least one water level sensor 140 is equal to or greater than the first reference water level A. The processor 110 may be further configured to control the power of the forced air current generating apparatus 60 to be turned off, in response to determining that the collected amount is less than the first reference water level A.

The processor 110 may be further configured to operate in the condensed water heating state for heating the condensed water stored in the condensed water collecting apparatus 50 through the at least one flow path according to the selected operating course, in response to determining that the collected amount is equal to or greater than the second reference water level B that is a water level higher than the first reference water level A, and operate in the condensed water heating stopped state when a time of the selected operating course is completed. The processor 110 may be further configured to control the power of the forced air current generating apparatus 60 to be turned on until it is determined that the collected amount is equal to or less than the second reference water level B.

The processor 110 may be further configured to stop the operation of the heat pump apparatus 40 to stop the selected operating course, in response to determining that the collected amount is equal to or greater than the threshold water level C that is a water level higher than the first reference water level A, operate in the condensed water heating stopped state, based on the stopping of the operating course, and control the power of the forced air current generating apparatus 60 to be turned on until it is determined that the collected amount is equal to or less than the threshold water level C.

The clothes care apparatus 1 may further include the at least one temperature sensor 120 configured to measure the ambient temperature of the condensed water collecting apparatus 50, and the at least one humidity sensor 130 configured to measure the ambient humidity of the condensed water collecting apparatus 50. The processor 110 may be further configured to control the operation of the forced air current generating apparatus 60, based on the ambient humidity measured by the at least one humidity sensor 130, in response to determining that the ambient temperature measured by the at least one temperature sensor 120 is greater than the first reference temperature X.

The processor 110 may be further configured to control the power of the forced air current generating apparatus 60 to be turned off, in response to determining that the ambient humidity is less than the reference humidity a. The processor 110 may be further configured to control the power of the forced air current generating apparatus 60 to be turned on, in response to determining that the ambient humidity is greater than the reference humidity a.

A control method for controlling the clothes care apparatus 1, according to an embodiment of the disclosure, includes receiving selection on the operating course for taking care of the target in the accommodating chamber 20, and controlling the heat pump apparatus 40 connected to the refrigerant pipe 45 in which the refrigerant circulates, and including the compressor 41, the condenser 43, the expansion apparatus 44, and the evaporator 42, based on the selected operating course. The clothes care apparatus 1 includes the condensed water collecting apparatus 50 configured to collect the condensed water generated from the heat pump apparatus 40, and the at least one flow path for transmitting the refrigerant of the high-temperature state, among the refrigerant pipe 45 of the heat pump apparatus 40, passes through the storage space of the condensed water stored in the condensed water collecting apparatus 50.

The control method may further include controlling the forced air current generating apparatus 60 arranged to form the forced air current on a surface of the condensed water stored in the condensed water collecting apparatus 50.

The at least one flow path may be the refrigerant pipe 45 for transmitting the refrigerant of the high-temperature state, discharged from the compressor 41, to the condenser 43.

The at least one flow path may be the refrigerant pipe 45 for transmitting the refrigerant of the high-temperature state, discharged from the condenser 43, to the expansion apparatus 44.

The control method may further include, in response to determining that the collected amount measured by the at least one water level sensor 140 configured to measure the collected amount of the condensed water collected in the condensed water collecting apparatus 50 is less than the threshold water level C, controlling the operation of the heat pump apparatus 40 according to the selected operating course, and operating in the condensed water heating state for heating the condensed water stored in the condensed water collecting apparatus 50 through the at least one flow path, and in response to determining that the collected amount is equal to or greater than the threshold water level, stopping the operation of the operating course and operating in the condensed water heating stopped state, based on the stopping of the operating course.

The control method may further include, in response to determining that the collected amount measured by at least one water level sensor 140 configured to measure the collected amount of the condensed water collected in the condensed water collecting apparatus 50 is equal to or greater than the first reference water level A, controlling the power of the forced air current generating apparatus 60 to be turned on, and in response to determining that the collected amount is less than the first reference water level A, controlling the power of the forced air current generating apparatus 60 to be turned off.

The control method may further include, in response to determining that the ambient temperature measured by the at least one temperature sensor 120 configured to measure the ambient temperature of the condensed water collecting apparatus 50 is greater than the first reference temperature X, controlling the operation of the forced air current generating apparatus 60, based on the ambient humidity measured by the at least one humidity sensor 130 configured to measure the ambient humidity of the condensed water collecting apparatus 50, in response to determining that the ambient humidity is less than the reference humidity a, controlling the power of the forced air current generating apparatus 60 to be turned off, and in response to determining that the ambient humidity is greater than the reference humidity a, controlling the power of the forced air current generating apparatus 60 to be turned on.

A control method for the clothes care apparatus 1, according to an embodiment of the disclosure, may heat condensed water stored in a condensed water collecting apparatus by passing at least one flow path transmitting a refrigerant of a high-temperature state among a refrigerant pipe of a heat pump apparatus through the condensed water collecting apparatus. Also, a clothes care apparatus according to an embodiment of the disclosure may improve user convenience because a process by which a user periodically discharges condensed water is omitted as evaporation of the condensed water heated by at least one flow path is accelerated. In addition, a clothes care apparatus according to an embodiment of the disclosure may not require an additional pipe for discharging condensed water stored in a condensed water collecting apparatus, as a portion of a refrigerant pipe operates as a condensed water heating apparatus.

A machine-readable storage medium may be provided in the form of a non-transitory storage medium. Here, the "non-transitory storage medium" only denotes a tangible device and does not contain a signal (for example, electromagnetic waves). This term does not distinguish a case where data is stored in the storage medium semi-permanently and a case where the data is stored in the storage medium temporarily. For example, the "non-transitory storage medium" may include a buffer where data is temporarily stored.

According to an embodiment of the disclosure, a method according to the embodiment of the disclosure in the present specification may be provided by being included in a computer program product. The computer program products are products that can be traded between sellers and buyers. The computer program product may be distributed in a form of machine-readable storage medium (for example, a compact disc read-only memory (CD-ROM)), or distributed (for example, downloaded or uploaded) through an application store or directly or online between two user devices (for example, smart phones). In the case of online distribution, at least a part of the computer program product (for example, a downloadable application) may be at least temporarily generated or temporarily stored in a machine-readable storage medium, such as a server of a manufacturer, a server of an application store, or a memory of a relay server.

The invention claimed is:

1. A clothes care apparatus comprising:

an accommodating chamber to accommodate a target;

a heat pump apparatus to dehumidify and heat air circulating through the accommodating chamber, the heat pump apparatus including a refrigerant pipe through which a refrigerant circulates and at least one of a compressor, a condenser, an expansion apparatus, or an evaporator; and a condensed water collecting apparatus configured to collect condensed water generated from the heat pump apparatus, and having a storage space in which the collected condensed water is stored, wherein a portion of the refrigerant pipe passes through the storage space so that, in an operating course for taking care of the target, the refrigerant circulating through the refrigerant pipe passes through the portion of the refrigerant pipe while in a high temperature state, to evaporate the condensed water stored in the storage space.

2. The clothes care apparatus of claim 1, wherein the refrigerant in the high temperature state that passes through the portion of the refrigerant pipe is discharged from the compressor and transmitted to the condenser.

3. The clothes care apparatus of claim 1, wherein the refrigerant in the high temperature state that passes through the portion of the refrigerant pipe is discharged from the condenser and transmitted to the expansion apparatus.

4. The clothes care apparatus of claim 1, wherein the portion of the refrigerant pipe has a winding shape.

5. The clothes care apparatus of claim 1, further comprising:

a forced air current generating apparatus configured to generate a forced air current in the condensed water collecting apparatus, wherein the forced air current generating apparatus is arranged so that, with the collected condensed water being stored in the condensed water collecting apparatus, the forced air current generating apparatus faces a surface of the collected condensed water.

6. The clothes care apparatus of claim 5, further comprising:

at least one water level sensor configured to measure an amount of the collected condensed water in the condensed water collecting apparatus, and a processor is configured to control the forced air current generating apparatus based on a result of comparing the amount of the collected condensed water measured by the at least one water level sensor and a first reference water level.

7. The clothes care apparatus of claim 6, wherein the processor is configured to:

control power of the forced air current generating apparatus to be turned on in response to a determination that the amount of the collected condensed water measured by the at least one water level sensor is greater than the first reference water level, and control the power of the forced air current generating apparatus to be turned off in response to a determination that the amount of the collected condensed water is less than the first reference water level.

8. The clothes care apparatus of claim 6, wherein the processor is configured to:

operate in a condensed water heating state to heat the collected condensed water stored in the storage space through the portion of the refrigerant pipe according to a selected operating course, in response to a determination that the amount of the collected condensed water is greater than a second reference water level that is higher than the first reference water level, operate in a condensed water heating stopped state with the selected operating course being completed, and control power of the forced air current generating apparatus to be turned on until it is determined that the amount of the collected condensed water is less than the second reference water level.

9. The clothes care apparatus of claim 6, wherein the processor is configured to:

stop an operation of the heat pump apparatus to stop a selected operating course in response to a determination that the amount of the collected condensed water is greater than a threshold water level that is higher than the first reference water level, operate in a condensed water heating stopped state based on the stopping of the operating course, and control power of the forced air current generating apparatus to be turned on until it is determined that the amount of the collected condensed water is less than the threshold water level.

10. The clothes care apparatus of claim 5, further comprising:

at least one temperature sensor configured to measure an ambient temperature of the condensed water collecting apparatus;

at least one humidity sensor configured to measure an ambient humidity of the condensed water collecting apparatus; and a processor is configured to control an operation of the forced air current generating apparatus based on the ambient humidity measured by the at least one humidity sensor, in response to a determination that the ambient temperature measured by the at least one temperature sensor is greater than a first reference temperature.

11. The clothes care apparatus of claim 10, wherein the processor is configured to:

control power of the forced air current generating apparatus to be turned off in response to a determination that the ambient humidity is less than a reference humidity, and control the power of the forced air current generating apparatus to be turned on in response to a determination that the ambient humidity is greater than the reference humidity.

12. The clothes care apparatus of claim 1, further comprising:

at least one water level sensor configured to measure an amount of the collected condensed water in the condensed water collecting apparatus, and a processor configured to, in response to a determination that the amount of the collected condensed water measured by the at least one water level sensor is less than a threshold water level, control the heat pump apparatus to:

operate, according to a selected operating course, in a condensed water heating state in which the collected condensed water is heated by the refrigerant in the high temperature state that passes through the portion of refrigerant pipe.

13. The clothes care apparatus of claim 12, wherein the processor is configured to, in response to a determination that the amount of the collected condensed water measured by the at least one water level sensor is greater than the threshold water level, control the heat pump apparatus to:

stop operation of the selected operating course and operate in a condensed water heating stopped state.

14. A control method of controlling a clothes care apparatus, the control method comprising:

receiving a selection of an operating course for taking care of a target in an accommodating chamber; and controlling a heat pump apparatus configured to dehumidify and heat air circulating through the accommodating chamber based on the selected operating course, wherein the heat pump apparatus includes a refrigerant pipe through which a refrigerant circulates and at least one of a compressor, a condenser, an expansion apparatus, or an evaporator, wherein the clothes care apparatus includes a condensed water collecting apparatus configured to collect condensed water generated from the heat pump apparatus, and having a storage space in which the collected condensed water is stored, wherein a portion of the refrigerant pipe passes through the storage space, and wherein the control method further comprises, in the selected operating course, controlling the heat pump apparatus so that the refrigerant circulating through the refrigerant pipe passes through the portion of the refrigerant pipe while in a high temperature state, to evaporate the condensed water stored in the storage space.

15. The control method of claim 14, further comprising:

controlling a forced air current generating apparatus arranged to generate a forced air current on a surface of the collected condensed water stored in the condensed water collecting apparatus.

16. The control method of claim 15, further comprising:

in response to determining that an amount of the collected condensed water, measured by at least one water level sensor configured to measure the amount of the collected condensed water in the condensed water collecting apparatus, being greater than a first reference water level, controlling power of the forced air current generating apparatus to be turned on; and in response to determining that the amount of the collected condensed water is less than the first reference water level, controlling the power of the forced air current generating apparatus to be turned off.

17. The control method of claim 15, further comprising:

in response to determining that an ambient temperature, measured by at least one temperature sensor configured to measure the ambient temperature of the condensed water collecting apparatus, is greater than a first reference temperature, controlling an operation of the forced air current generating apparatus based on an ambient humidity measured by at least one humidity sensor configured to measure the ambient humidity of the condensed water collecting apparatus;

in response to determining that the ambient humidity is less than a reference humidity, controlling power of the forced air current generating apparatus to be turned off; and in response to determining that the ambient humidity is greater than the reference humidity, controlling the power of the forced air current generating apparatus to be turned on.

18. The control method of claim 14, wherein the refrigerant in the high temperature state that passes through the portion of the refrigerant pipe is discharged from the compressor and transmitted to the condenser.

19. The control method of claim 14, wherein the refrigerant in the high temperature state that passes through the portion of the refrigerant pipe is discharged from the condenser and transmitted to the expansion apparatus.

20. The control method of claim 14, further comprising:

in response to determining that an amount of the collected condensed water, measured by at least one water level sensor configured to measure the amount of the collected condensed water in the condensed water collecting apparatus, is less than a threshold water level, controlling an operation of the heat pump apparatus according to the selected operating course, and operating in a condensed water heating state in which the collected condensed water is heated by the refrigerant in the high temperature state that passes through the portion of refrigerant pipe; and in response to determining that the amount of the collected condensed water is greater than the threshold water level, stopping operation of the selected operating course and operating in a condensed water heating stopped state.

* * * * *